US007053871B2

(12) United States Patent
Tomida et al.

(10) Patent No.: US 7,053,871 B2
(45) Date of Patent: May 30, 2006

(54) DISPLAY APPARATUS WITH GAS DISCHARGE TUBE AND METHOD OF DRIVING GAS DISCHARGE TUBE

(75) Inventors: Kazuo Tomida, Tokyo (JP); Masaki Hirohashi, Sagamihara (JP); Jun Kuwata, Tokyo (JP); Hiroko Imamura, Kawasaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 434 days.

(21) Appl. No.: 10/157,183

(22) Filed: May 30, 2002

(65) Prior Publication Data

US 2002/0180664 A1 Dec. 5, 2002

(30) Foreign Application Priority Data

May 31, 2001 (JP) ..... 2001-164470
Mar. 1, 2002 (JP) ..... 2002-055602

(51) Int. Cl.
*G09G 3/28* (2006.01)

(52) U.S. Cl. ..... 345/60; 345/37; 345/41; 345/102

(58) Field of Classification Search ..... 345/37, 345/41, 42, 60, 61, 62, 63, 100, 102
See application file for complete search history.

(56) References Cited

U.S. PATENT DOCUMENTS 5,461,397 A * 10/1995 Zhang et al. ..... 345/102
5,907,222 A * 5/1999 Lengyel et al. ..... 315/158
6,376,994 B1 * 4/2002 Ochi et al. ..... 315/169.1
6,697,036 B1 * 2/2004 Yamada et al. ..... 345/87

FOREIGN PATENT DOCUMENTS

JP 2001-125066 5/2001

* cited by examiner

*Primary Examiner*—Xiao Wu
*Assistant Examiner*—Jean Lesperance
(74) *Attorney, Agent, or Firm*—McDermott Will & Emery LLP

(57) ABSTRACT

A method of driving a gas discharge tube is provided. Each field of images is divided into three periods for luminescence-rest, luminescence-preparing, and luminescence steps. During the luminescence-rest step, two voltages whose amplitudes are the same and constant are applied to two sustaining electrodes composing each pair, so that the sustaining electrodes rest the discharge. During the luminescence-preparing step, two voltage pulses whose phases are the same are applied to the two sustaining electrodes composing each pair and a voltage to cause a preparatory discharge is applied to an auxiliary electrode. And during the luminescence step, two voltage pulses whose phases are mutually shifted are applied to the two sustaining electrodes composing each pair, so that the sustaining electrodes cause discharges for the luminescence.

18 Claims, 18 Drawing Sheets

DISPLAY APPARATUS WITH GAS DISCHARGE TUBE AND METHOD OF DRIVING GAS DISCHARGE TUBE

BACKGROUND OF THE INVENTION

1. Technical Field

The present invention relates to a display apparatus with a backlight, such as a liquid crystal display (LCD), and in particular, to both a display apparatus that uses a gas discharge tube as the backlight and a method of driving the gas discharge tube.

2. Related Art

A conventional LCD is usually provided with a backlight unit and a liquid crystal shutter placed on the backlight unit. The backlight unit is composed of various constituents including a straight tubular type or an L-shaped type of cold cathode discharge lamp, a light-guide plate, a reflection plate, and a polarization plate, thus emitting light of a certain luminance. The liquid crystal shutter is subjected to electrical control for adjusting its light transmittance. The light emitted from the backlight unit is used to display images of arbitrary gradations in response to light transmittances of the liquid crystal shutter.

However, in cases where such LCDs are used in monitor devices of televisions or personal computers, moving pictures are disturbed due to the liquid crystal shutter, because the shutter has a response speed as slow as the order of milliseconds. For displaying a moving picture, picture disturbances result in that image-pixel information which should be displayed during the last field remains at some pixels of an image to be displayed during the current field, even though those pixels should be excluded from luminescence during the current field. In such situations, image information is displayed erroneously with blurs and/or runs, which degrades image quality largely.

FIGS. 1A and 1B explain such disturbances of images, in which the axis of ordinates shows the time, thus one grid expressing a single field, while the axis of abscissae shows both pixel positions in an LCD image and luminances at each pixel. The graphs in FIGS. 1A and 1B depict images viewed by the human eyes under the condition that images moved two pixies per field.

FIG. 1A explains a situation where the response speed of the liquid crystal shutter is 0 msec, which is the ideal response speed. In this ideal case, there are no temporal changes in the luminances at each pixel during each field. Hence images whose temporal and spatial luminances are uniform are moved to specified position field by field. Accordingly, the images on an LCD monitor can be viewed by the human eyes as they are, without blurs resulting from the response speed. An exception is that, differently from CRT monitors, the LCD monitors provide images blurred, to some extent, by the fact that the luminescence lasts during the entire period of each period. This is because, when moving pictures are displayed, the lasting luminescence during each field, without a rest, causes images to be elongated in the moving direction of the images, and such elongated images are subjected to observation of the human eyes.

Meanwhile, FIG. 1B explains another situation where the rise time of the liquid crystal shutter is 16 msec. Moving pictures to be displayed are able to reach their desired luminances after a period of time of 16 msec due to the response time. Then, after another time of 16 msec., the liquid crystal shutter has a light transmittance of 0%. This results in that an image which should be displayed only during one field is forcibly visualized over the two fields. Thus, if a moving picture that moves in the frame every field is displayed, the human eyes observe images which are enlarged in the moving direction of the images, that is, blurred in the that direction. Quality of images displayed on an LCD monitor is therefore deteriorated badly.

In addition, a conventional flat type of backlight for LCD units can be driven according to a technique shown in FIG. 2, in which two types of sustaining voltage pulses whose cycles are different by half a cycle from each other are applied to sustaining electrodes during a luminescence period. The sustaining voltages are responsible for sustaining discharges. Additionally, as shown in FIG. 2, to make the discharge stable in the next lighting period, voltage pulses for pilot discharges, which have amplitudes less than those of the sustaining voltage pulses, are applied to the sustaining electrodes during a luminescence-rest period. Applying such pilot-discharging voltage pulses in the luminescence-rest period also generates a certain level of luminance, not a luminance of zero, on the screen during the luminescence-rest period.

When such an LCD is mounted on televisions or personal computers as their monitors, a poor response of the LCD will cause a problem, due to the fact that there is a certain level of luminescence during the luminescence-rest period. The response of the shutter incorporated in the LCD is generally limited to the range from a few milliseconds to several tens of milliseconds. Hence, to display moving pictures whose contents change every field (i.e., every period of 16.7 msec) is liable to being mixed with the image of the last field, thus blurs or runs still being present in images.

Further, when elongating the repetition time of both the lighting period and the luminescence-rest period to as large as 16.7 msec, the lighting is made unstable.

SUMMARY OF THE INVENTION

The present invention has been made with due consideration to the foregoing drawbacks. An object of the present invention is to provide higher-quality images even when moving pictures are displayed on display apparatuses such as LCD units.

A more practical first object of the present invention is to prevent or suppress information about an image indicative of the last field from being displayed erroneously in the period of the current field, thus improving image quality when moving pictures are displayed.

A more practical second object is to prevent an image from being deteriorated due to blurs or runs by stopping the luminescence during the luminescence-rest period.

A more practical third object is to gain a stable discharge start performance of the gas discharge tube, independently of amounts of space electric charges in a discharging space of the tube, thus leading to acquisition of higher-quality of images.

In order to achieve the above first object, as one example, a display apparatus according to the present invention comprises a shutter of which light transmittance is changeable; a gas discharge tubes for lightening the shutter; a shutter controller for controlling the light transmittance of the shutter on the basis of luminance information about an image to be displayed; and a discharge controller for controlling a discharge state of the gas discharge tube in accordance with a light transmittance state acquired when the shutter controls the light transmittance responsively to the luminance information.

It is preferred that the discharge controller includes: a field detector configured to detect a period of each field from the image to be displayed; a lighting period controller configured to control the period of each field so that the period of each field is divided in sequence into a luminescence-rest period during which the gas discharge tube is subjected to either one of a reduction of an intensity of light emitting therefrom and a rest of the luminescence thereof in cases where the light transmittance state of the shutter is out of a desired light transmittance range, a luminescence-preparing period during which the luminescence of the gas discharge tube is prepared, and a luminescence period during which the gas discharge tube performs the luminescence; and an applied-voltage generator configured to generate a voltage signal to be supplied to the gas discharge tube, the voltage signal being formed depending on a difference among the luminescence-rest, luminescence-preparing, and luminescence periods.

It is also preferred that the shutter controller includes a shutter control signal generator configured to generate a shutter control signal for controlling the light transmittance of the shutter from the luminance information about the image, and the discharge controller further includes a luminance detector configured to detect a luminance of the image from the shutter control signal, wherein the lighting period controller is configured to changeably control a length of the luminescence-rest period in accordance with the luminance of the image detected by the luminance detector.

Hence, the response speed of the shutter (for instance, a liquid crystal shutter) is detected to obtain the light transmittance thereof. Depending on the obtained light transmittance of the shutter, the discharge actions of the gas discharge tube are controlled. Even if moving pictures are displayed on an LCD unit, information about images which should be displayed in the period of the last field is suppressed or removed from being displayed erroneously. Thus blurs or runs are removed from images, which provides higher-quality images on the LCD unit.

In order to achieve the above second and third objects, by way of example, the present invention provides a method of driving a gas discharge tube having a plurality of glass substrates placed to form a discharging spacing with which a rare gas is filled, one or more pairs of sustaining electrodes embedded in a dielectric layer, and an auxiliary electrode placed insulatedly apart from the sustaining electrodes, the method comprising the steps of: performing a luminescence rest by applying two voltages whose amplitudes are the same and constant to two sustaining electrodes composing each pair among the paired sustaining electrodes, so that the sustaining electrodes rest the discharge; performing a luminescence preparation during a predetermined time of period, after the luminescence-rest step, by not only applying two voltage pulses whose phases are the same to the two sustaining electrodes composing each pair but also applying a voltage to cause a preparatory discharge to the auxiliary electrode; and performing a luminescence of the gas discharge tube, after the luminescence-preparing step, by applying two voltage pulses whose phases are mutually shifted to the two sustaining electrodes composing each pair, so that the sustaining electrodes cause discharge for the luminescence.

Thus, the discharge is first initiated using the auxiliary electrode, that is, between the sustaining and auxiliary electrodes during the luminescence-preparing step. This preparation step allows an arbitrary-length luminescence-rest step to be placed before a lightening period. Therefore, independently of amounts of electric charges that is present in the tube, the performance for staring the discharge can be made stable.

Further, the light-adjusting range of the gas discharge tube can be widened noticeably. Still, the luminescence from the tube can be made zero, field by field, during the luminescence-rest period. Both the luminescence and luminescence-rest periods can therefore be set to any proper lengths according to the response performance of a shutter of the liquid crystal display. Thus, even if moving pictures are displayed, blurs or runs induced from the last field, on account of a limited response speed of the liquid crystal shutter, can be suppressed from appearing in an image of the current field.

It is preferred that the two voltage pulses applied to the two sustaining electrodes composing each pair are mutually shifted in phases by half a cycle of each voltage pulse. By way of example, during the luminescence step, a summed voltage of the two voltage pulses is applied to the auxiliary electrode.

It is also preferred that during the luminescence step, each of the two voltage pulses applied to the two sustaining electrodes composing each pair is set to have a duty ratio ranging from approximately 10 to 90 percents. This configuration makes it possible to drive the tube with a lower-frequency signal (i.e., a wider pulse width), so that both of power consumption and heat generated from a drive circuit can be saved. In particular, it is preferred that during the luminescence step, the two voltage pulses applied to the two sustaining electrodes composing each pair are adjusted in the phases so that a pulsed waveform of voltage generated in the discharging spacing is adjusted in pulse width.

Preferably, the two voltage pulses applied to the two sustaining electrodes composing each pair during the luminescence-preparing step are different in a cycle from the two voltage pulses applied to the two sustaining electrodes composing each pair during the luminescence step.

Still preferably, voltage pulses from a first voltage pulse to a desired number of voltage pulses in a pulse sequence of each of the two voltage pulses applied to the two sustaining electrodes composing each pair during the luminescence-preparing step are different in a duty ratio from the two voltage pulses applied to the two sustaining electrodes composing each pair during the luminescence step.

By way of example, the luminescence-rest step is omitted during a predetermined period of time in an initial start state immediately after power of the display apparatus is put on.

It may also be configured that the driving method further comprises a step of performing a preparation for initial-start luminescence by not only applying two voltage pulses whose phases are the same to the two sustaining electrodes composing each pair but also applying a voltage to cause a preparatory discharge to the auxiliary electrode, in an initial start state immediately after power of the display apparatus is put on, the initial-start luminescence-preparing step being followed by the luminescence step.

It is also preferred that during the luminescence-rest step, in which the sustaining electrodes are arranged so as to divide a discharging area of the gas discharge tube into a plurality of sub-areas, sustaining electrodes located in a sub-area subjected to the luminescence are grounded and sustaining electrodes located in a sub-area subjected to non-luminescence are given voltage of a predetermined amplitude.

According to another aspect of the present invention, a gas discharge tube driven by the driving method is also provided.

BRIEF DESCRIPTION OF THE DRAWINGS

Other objects and aspects of the present invention will become apparent from the following description and embodiments with reference to the accompanying drawings in which.

DETAILED DESCRIPTION OF PREFERRED EMBODIMENT

Referring to the accompanying drawings, various preferred embodiments of the present invention will now be described.

First Embodiment

Figure 1A:
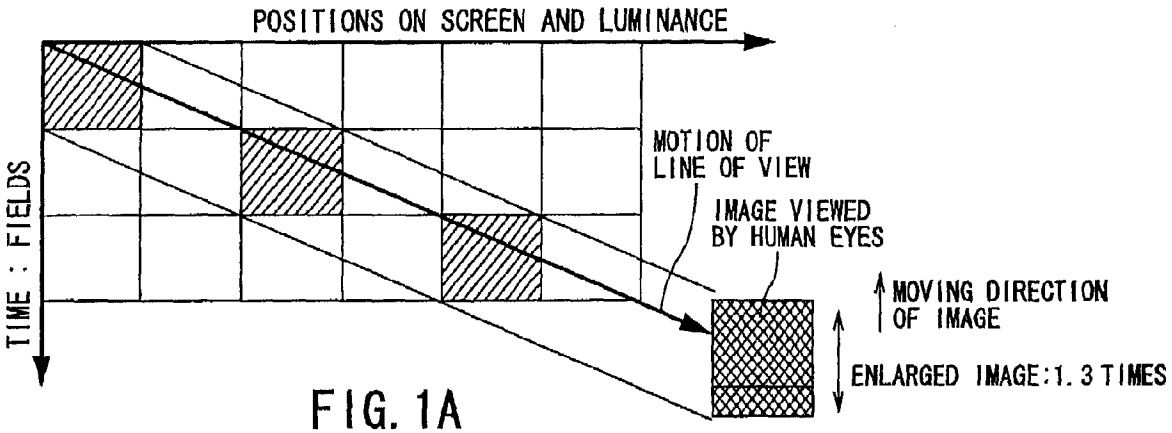
FIG. 1A PRIOR ART
FIGS. 1A and 1B illustrate disturbances in an image, which occurs when moving pictures are displayed by a conventional liquid crystal display.
Figure 1B:
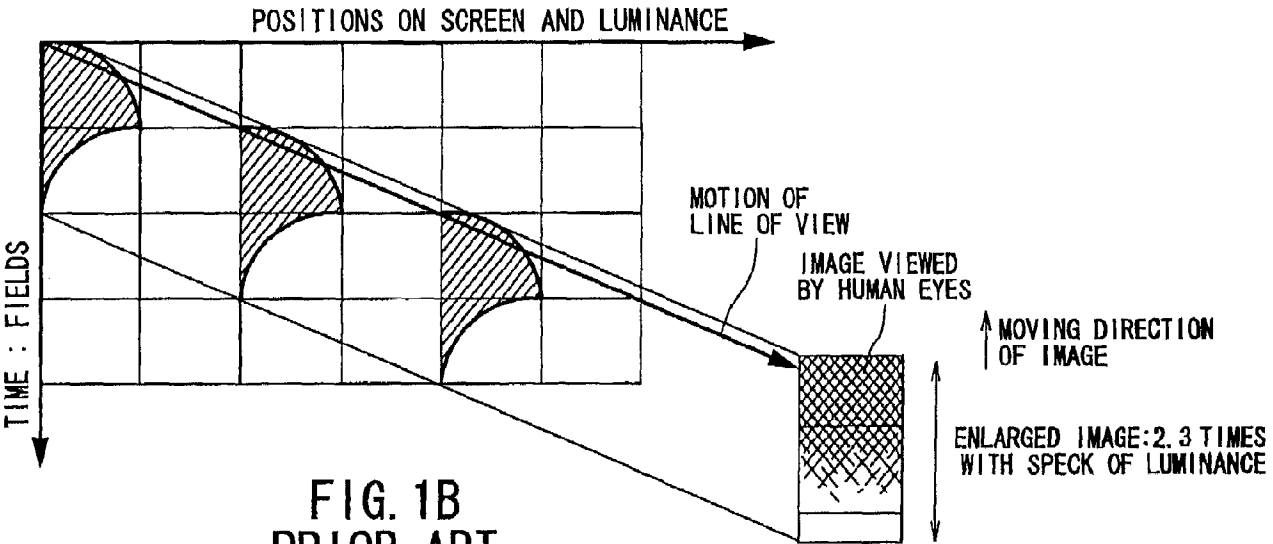
FIG. 1B PRIOR ART
Figure 2:
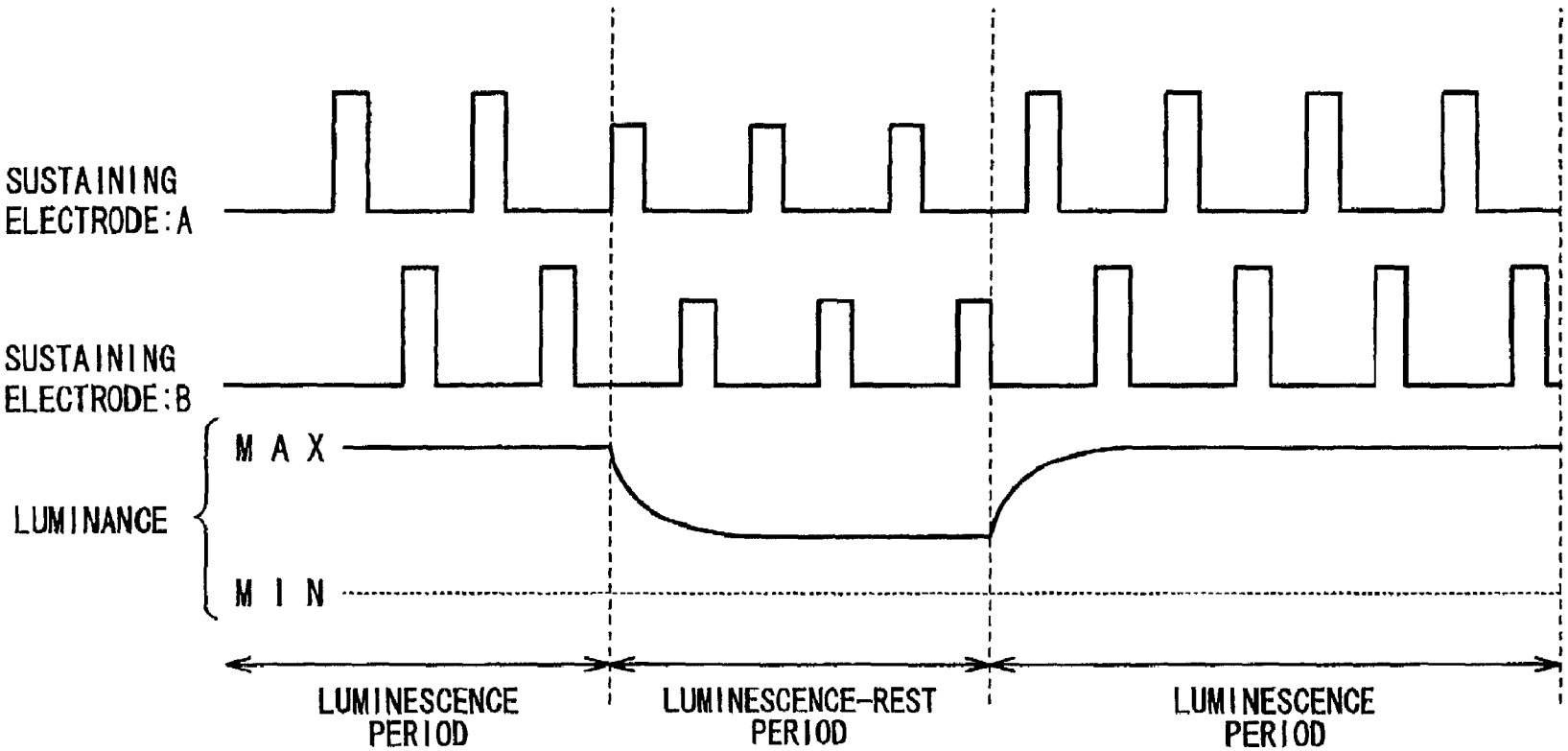
FIG. 2 PRIOR ART
FIG. 2 exemplifies conventionally used voltage pulses for driving a gas discharge tube.
Figure 3:
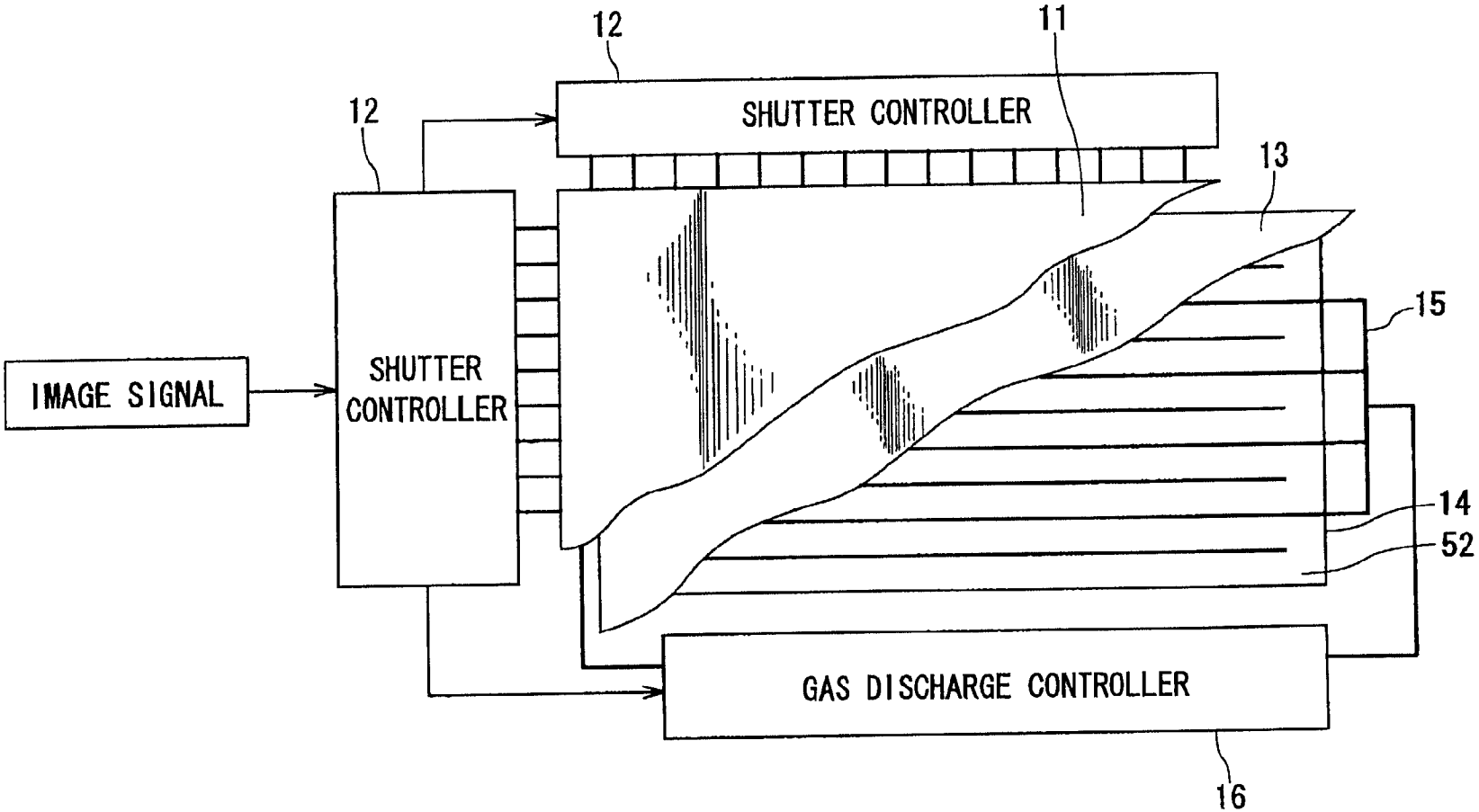
FIG. 3 shows a partial schematic configuration of a display apparatus according to a first embodiment of the present invention, in which a backlight of the display apparatus is shown.
Figure 4:
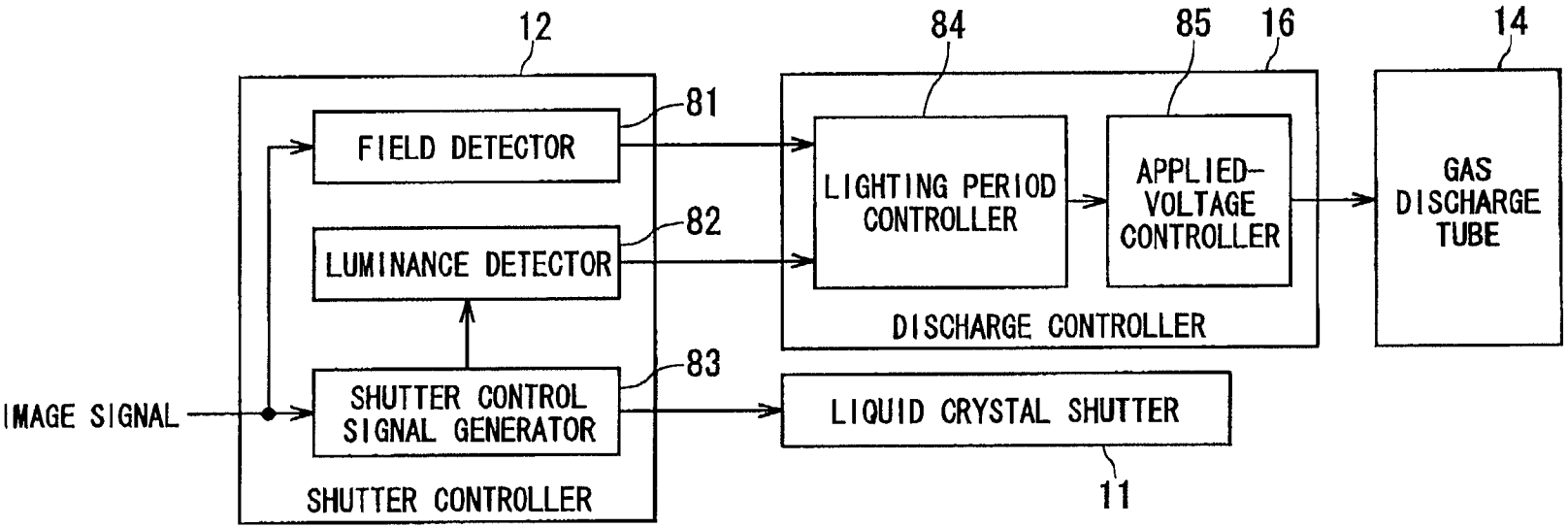
FIG. 4 is a block diagram showing part of the backlight.
Figure 5:
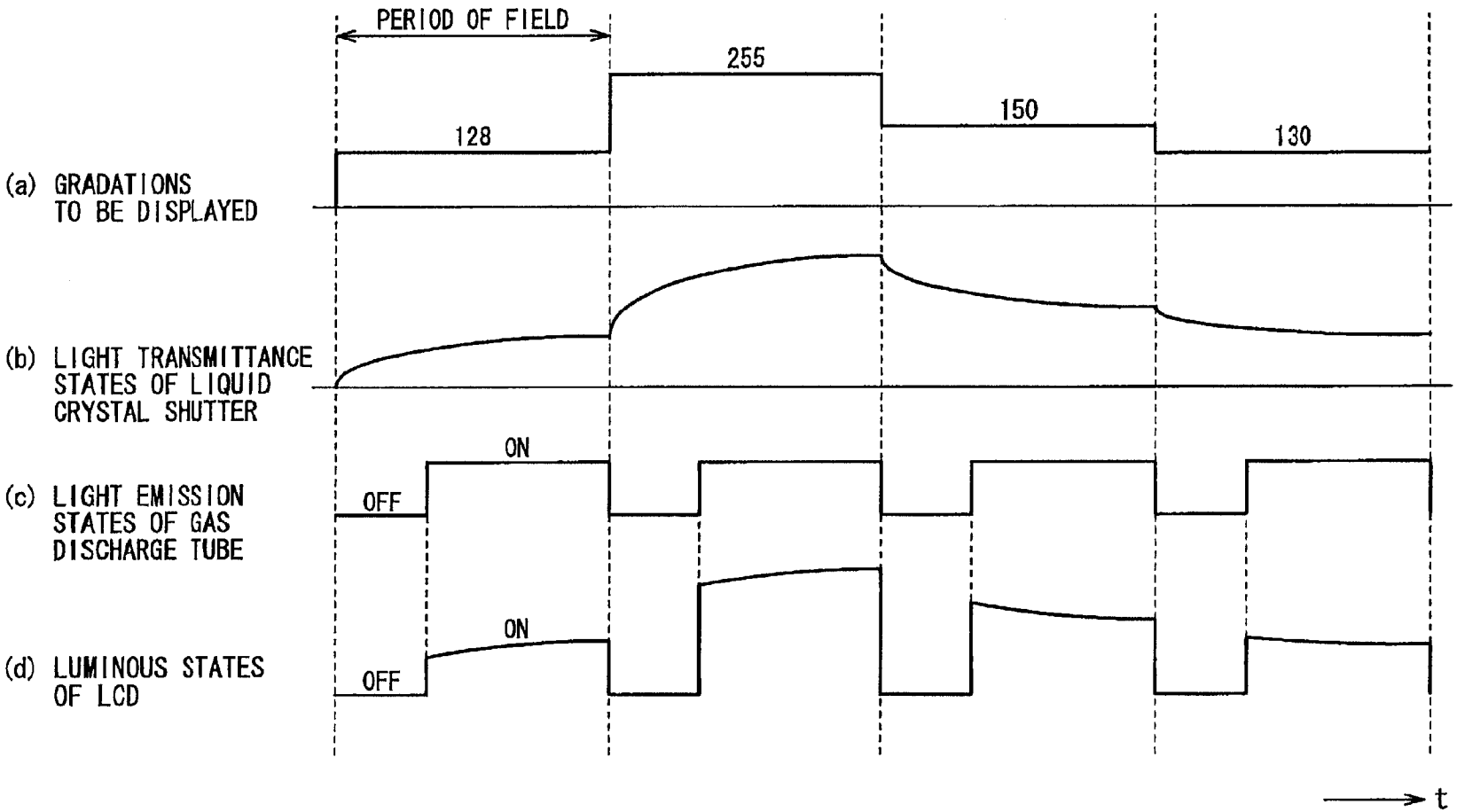
FIG. 5 shows timing charts to explain characteristics of light emission states of the gas discharge tube and luminous states of an LCD when various gradations are given.

Referring to FIGS. 3 to 5, a first embodiment of the present invention will now be described.

FIG. 3 conceptually shows the configuration of a display apparatus according to a first embodiment of the present invention. This display apparatus is equipped with a liquid crystal shutter 11, a shutter controller 12, a polarization plate 13, a gas discharge tube 14, a plurality of electrodes 15 disposed in the gas discharge tube 14, and a gas discharge controller 16.

FIG. 4 shows the schematic configuration of both of the shutter controller 12 and the discharge controller 16. The shutter controller 12, which receives an image signal, includes a field detector 81, a luminance detector 82, and a shutter control signal generator 83. In the shutter controller 12, the inputted image signal is supplied to both of the field detector 81 and the shutter control signal generator 83.

The field detector 81 detects the start timing of each field from the inputted image signal to form a field start signal, where the field start signal is outputted to the gas discharge controller 16. On the other hand, the shutter control signal generator 83 produces, from the inputted image signal, a shutter control signal for each field, and provides it to both the luminance detector 82 and the liquid crystal shutter 11. The luminance detector 82 computes, based on the shutter control signal, the luminance of an image (that is, a brighter image or a darker image) to be displayed. The computed luminance is formed as a screen luminance signal, and this signal is sent to the discharge controller 16. In the present embodiment, the luminance of an image is computed as a mean value over an entire image. Alternatively, the luminance of an image may be calculated based on part of an image. Still, a maximum luminance of an image is an alternative for such value. Still alternatively, the luminance detector 82 may be configured so that it receives an image signal to calculate the luminance of the image.

Based on the computed mean screen luminance, the light-emitting operations of the gas discharge tube 14 are controlled. Practically, when the mean screen luminance is lower compared to a predetermined value, the gas discharge controller 16 operates to shorten a luminescence-rest period for the gas discharge tube 14. Thus the luminescence from the gas discharge tube 14 is increased, whereby a change amount of luminance per one luminescence gradation being made larger. In contrast, when the mean screen luminance is higher compared to the predetermined value, the gas discharge controller 16 controls the gas discharge tube 14 so as to make the luminescence-rest period. Hence the luminance of the gas discharge tube 14 is reduced, thereby lessening the luminance saturation in a higher part of the gradations.

The liquid crystal shutter 11 receives the shutter control signal from the shutter controller 12 to change light transmittances at arbitrary pixel positions. The light emanating from the gas discharge tube 14 can therefore be transmitted through the shutter 11 of which arbitrary pixel portions are controlled, so that an image is visualized in a luminance-controlled manner.

The gas discharge controller 16, which is provided with a lighting period controller 84 and an applied-voltage producer 85, receives both of the field start signal and the screen luminance signal, which are sent from the shutter controller 12. Both of such signals are inputted to the lighting period controller 84, in which changeable timings of a lighting period and a luminescence-rest period that compose a period of each field is calculated using both of the signals to produce and output a lighting period signal. On the other hand, the applied-voltage producer 85 is configured to receive the lighting period signal to control the gas discharge tube 14 such that the producer 85 provides the tube 14 with a voltage signal of both a controlled frequency and a controlled pulse width. Alternatively the above lighting period controller 84 may be located within the shutter controller 12, instead of being placed within the discharge controller 16.

The timing charts in FIG. 5 conceptually shows light-transmittance states controlled by the liquid crystal shutter 11 on condition that the gas discharge tube 14 is turned off during an early part of period corresponding to 30% of each field. FIG. 5(*a*) shows, field by field, gradations to be displayed at any pixel based on 256 gradations, in which the chart shows gradations that change in turn from 128, 255, 150, and to 130. FIG. 5(*b*) shows light transmittance states of the liquid crystal shutter 11 whose the rise time is set to 16 msec. and transmits the light of the gradations shown in FIG. 5(*a*). On starting a period of each field, voltage is applied to the liquid crystal shutter 11, but it takes 16 msec. for the shutter 11 to provide a specified light transmittance. Thus, a desired level of luminance cannot be attained during an early part of each field. In addition, FIG. 5(*c*) depicts light-emitted states of the gas discharge tube 14. Those states are obtained on condition that the tube 14 is turned off during an early part of period corresponding to 30% of each field and turned on during a last part of period corresponding to 30% thereof. FIG. 5(*d*) shows luminous states of an LCD in which the gas discharge tube 14 shown in FIG. 5(*c*) is used. During the early part of each field, the LCD is not luminous, because the gas discharge tube 14 is turned off. When the gas discharge tube 14 is driven into its turn-on state, the luminescence of the LCD is started as well. Hence the luminescence state in each field can be expressed by a curve closer to a rectangular form, providing images of preferable gradations.

As described above, in the case of the LCD according to the present embodiment, timings to turn on or off the back light of the gas discharge tube 14 is controlled depending on the response speed of the liquid crystal shutter 11. Specifically, the gas discharge tube 14 is turned off during an early part of period of each field, while it is turned on during the remaining period of time of each field. Hence, a given early part of period of each field, which is undesirable in displaying an image having a specified intensity due to the fact that the shutter 11 has a certain response time, is disregarded by turning off the tube 14. This disregard makes it possible that the gradations of pixels to be displayed during each field come closer to their desired gradations. In addition, even if moving pictures are displayed, the above way of disregarding an early part of period of time prevents image information that should be displayed during the last field from influencing the current field. It is therefore possible to provide the LCD capable of showing higher-quality images with less disturbances.

In the case of the present embodiment, the ratio between a turned-on period and a turned-off period of the gas discharge tube 14 is set to a ratio of "3 to 7," but this ratio is not restricted to this value. Other ratios are also available for the period control and is able to provide the same advantages as the above.

Second Embodiment

Figure 6:
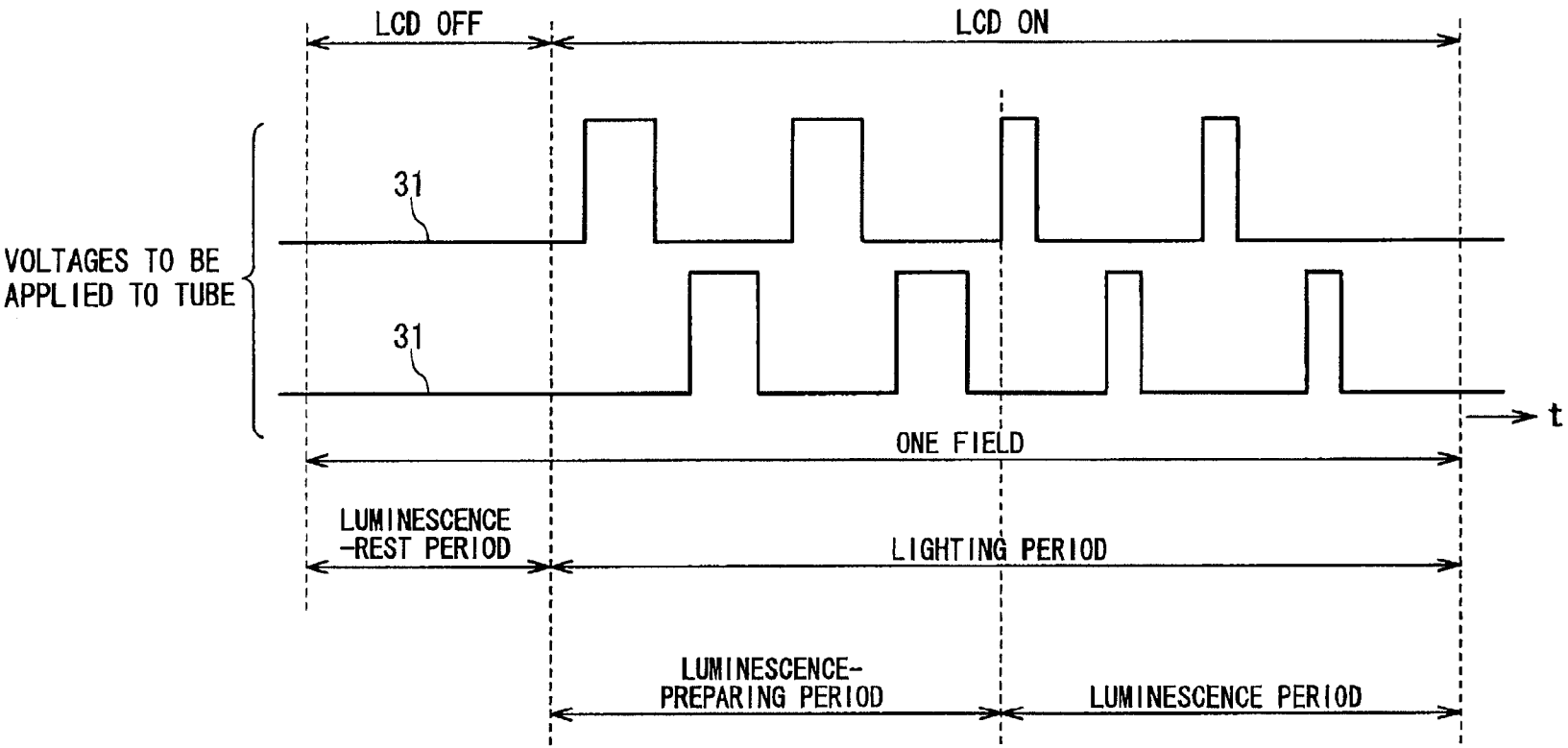
FIG. 6 represents timing charts to explain operations of a gas discharge tube used by a display apparatus according to a second embodiment of the present invention.

Referring to FIG. 6, a second embodiment of the present invention will now be described.

FIG. 6 shows a second concept achieved by the output signal from the gas discharge controller 16 shown in FIG. 3. As shown therein, the discharge tube 14 is driven by pulsed voltage 31 (whose pulse frequency and amplitude are for example 100 kHz and 1500 Volts, respectively). The period of each field is divided into a luminescence-rest period and a lighting period. The lighting period, which is placed to light the gas discharge tube 14, is further divided into a luminescence-preparing period and a luminescence period in cases where the luminescence-rest period last for 0.5 msec or more. During the luminescence-preparing period, the voltage pulses each of whose duration is 1.1 times larger than that of the luminescence period is applied over two cycles or more.

Making the duration of each voltage pulse applied in the luminescence-preparing period longer copes with the luminescence-rest period set longer. The presence of such luminescence-rest period allows the electric charges residing in a discharging space 52 (refer to FIG. 3) in the tube 14 to be re-combined with each other, which lessens the existence probability of the electric charges in the discharging space 52. When the lighting is launched in such a state, a less existence probability of the electric charges will cause a delay in the start of discharge in the tube 14. Therefore, if the duration of each voltage pulse to be applied to the tube 14 is kept to the conventional one, the applied voltage pulses will vanish before the start of firing discharge or in the course of establishing discharge. Sufficient space electric charges will therefore not remain in the discharging space 52. In addition, wall electric charges accumulated on the electrode 15 are still insufficient for the next discharge, so that the next application of the voltage pulses will not generate a steady discharge.

To resolve this problem, as stated above, the duration of each voltage pulse to be applied in the luminescence-preparing period is raised up to a length of 1.1 times as large as that in the luminescence period. The application of those voltage pulses lasts until at least the end of the discharge establishing process, even if the space electric charges remaining in the discharge space 52 is reduced. Therefore, it is possible that a steady discharge is generated during the luminescence period.

Figure 7:
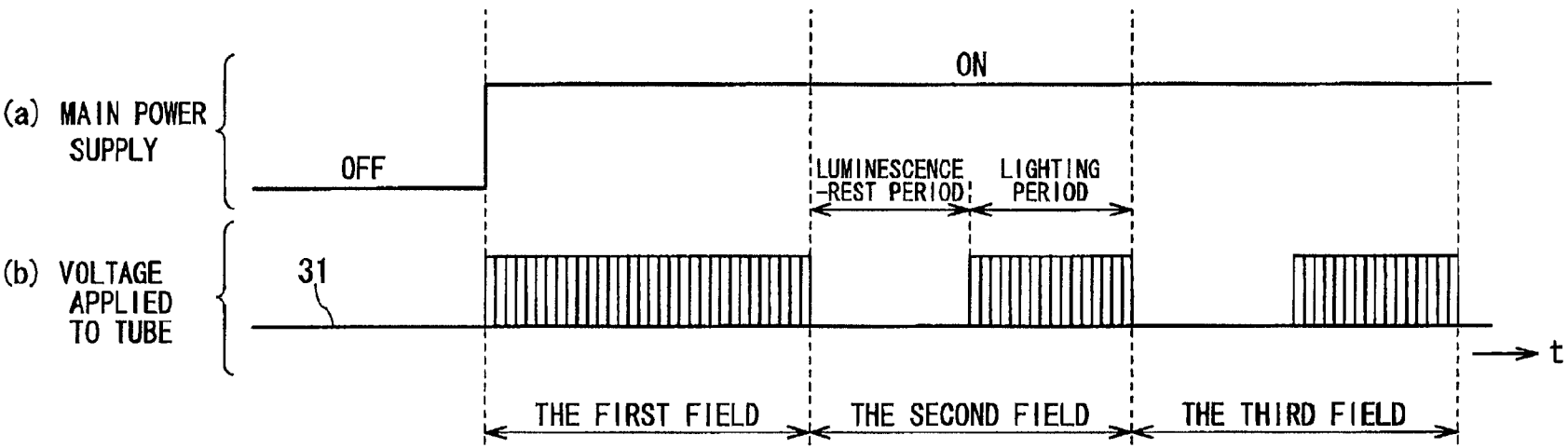
FIG. 7 shows timing charts to explain operations of a gas discharge tube used by a display apparatus according to a modification of the second embodiment of the present invention.

A modification of the second embodiment will now be described with reference to FIG. 7, which shows in waveforms both a voltage (FIG. 7(*a*)) of the main power supply incorporated in a display apparatus and voltage 31 (FIG. 7(*b*)) applied to the gas discharge tube 14 included in the display apparatus. FIG. 7 shows the charts of the voltages obtained immediately after the main power supply is first turned on. As shown in FIG. 7, the luminescence-rest period is not placed in one or more fields appearing immediately after turning on the main power supply unit, even where there is an image to be displayed. In the exemplified case, the luminescence-rest period is placed in the subsequent fields following the first field, not placed in the first field.

In most cases, the space electric charges remaining in the discharging space 52 in the first field are reduced in amount. Even in such a state, the gas discharge tube 14 enables its discharge to start with steadiness thanks to the restless application of the voltage.

Third Embodiment

Figure 8:
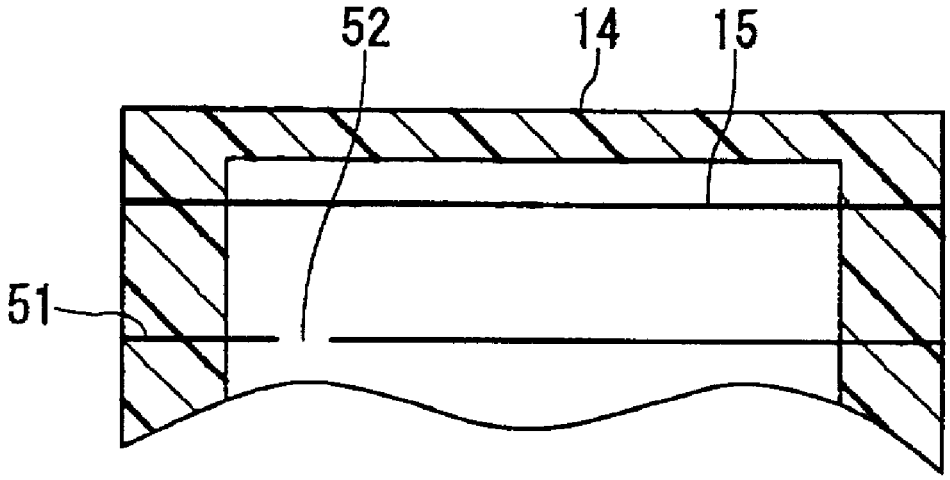
FIG. 8 shows in section part of a gas discharge tube used by a display apparatus according to a third embodiment of the present invention.

Referring to FIG. 8, a third embodiment of the present invention will now be described.

FIG. 8 shows a third configuration of the gas discharge tube 14 shown in FIG. 3. The gas discharge tube 14 uses a pair of flat glasses on each of which pluralities of electrodes 15 are disposed. The electrodes 15 are partially cut to form a plurality of auxiliary electrodes 51, though only one auxiliary electrode 51 is shown in FIG. 8. When the lighting is initiated, a different type of voltage from the main sustaining electrodes 15 is applied to the auxiliary electrodes 51. Because the distances to the axially electrodes 51 are closer than those to the main sustaining electrodes 15, the intensities of electric fields generated between the sustaining electrodes 15 become larger. Therefore, even when an amount of the space electric charges in the discharging space 52 is lessened, the discharge can be started with stability. Once the discharge has been started, the same type of voltage pulses as those to the sustaining electrodes 15 are applied to the auxiliary electrodes 51 so that the electrodes 51 are also utilized as original sustaining electrodes, causing no specks of luminance in the luminous surface.

The auxiliary electrodes 51 are grounded via resistors, so that no wall charges are accumulated on the sustaining electrodes 15 before the discharge is started, providing the grounded state of the electrodes 51. Thus, when applying voltage pules to an adjacent sustaining electrode, a discharge occurs between the sustaining and auxiliary electrodes. After completing the start of the discharge, the auxiliary electrodes 51 are separated from the ground by the resistors, thereby being equivalent in potential to the adjacent electrode. The auxiliary electrodes 51 no longer operate as auxiliary ones, and participate in performing the main discharging actions. The gas discharge tube 14 provides a luminous surface with a uniform luminance, with no specks of luminance therein.

Fourth Embodiment

Figure 9:
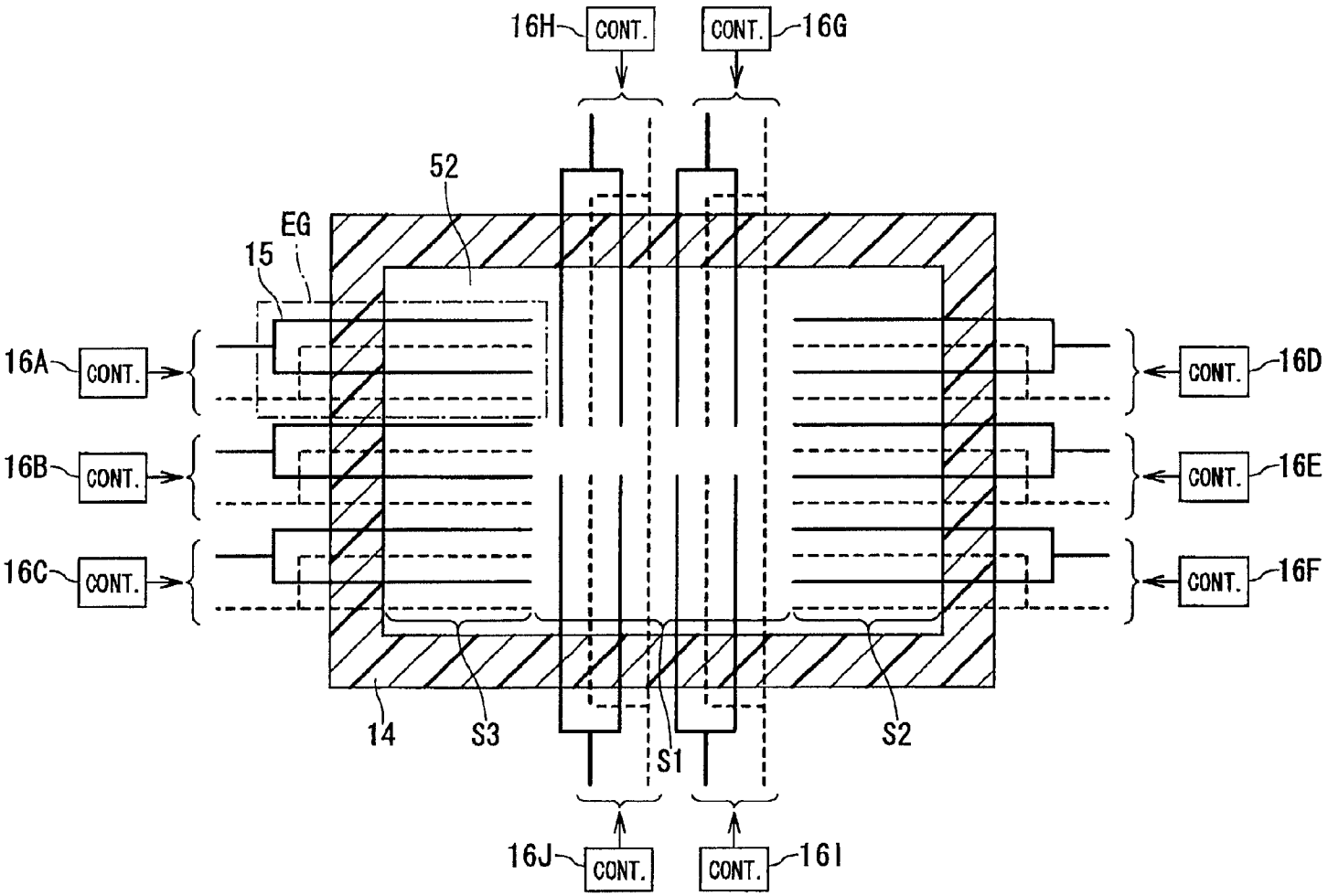
FIG. 9 is a schematic diagram showing control means and part of a gas discharge tube used by a display apparatus according to a fourth embodiment of the present invention.

Referring to FIG. 9, a fourth embodiment of the present invention will now be described.

FIG. 9 shows a fourth configuration of the gas discharge tube 14 shown in FIG. 3. The gas discharge tube 14 uses a pair of flat glasses on each of which pluralities of electrodes 15 are disposed so as to be divided into a plurality of electrode groups EG. Each electrode group EG is connected to each discharge controller 16A (to 16J). In the configuration exemplified in FIG. 9, there are ten electrode groups EG, and the entire discharging area (surface) of the tube 14 is divided into three sub-areas S1 to S3 located at the central, right, and left regions. As a result, both of the light control of the gas discharge tube 14 and the adjustment of a ratio between the lightening period and the luminescence-rest period of each field can be done based on an image to be displayed.

For example, for displaying images in which an object moves quickly at the central region, the lighting period of each field for the sustaining electrodes displaced at the central region is shortened to suppress disturbances in the images. But, each lighting period for the sustaining electrodes displaced at the peripheral regions is not shortened, with such electrodes allowed to discharge restlessly in the same manner as the conventional. Thus, when moving pictures are displayed on an LCD unit, its background images (in the right and left peripheral areas) are stable and images of the central area where moving objects are present are expressed with most disturbances removed.

The number of application times of voltage per field is adjusted to be equal for the electrodes disposed in both the central area and its peripheral areas. If not so, that is, such application number for the electrodes in the central area is different from that for the electrodes in its peripheral areas, the uniformity of luminance of the image fails. Thus, the cycle of application of voltage to the electrodes disposed in the peripheral areas is adjusted.

In addition, in cases where pixel values in the background are low and those in the central area are high, higher luminances coming from the gas discharge tube 14 cause the higher-value pixels to be expressed at blurred gradations. In contrast, lower luminances coming from the gas discharge tube 14 make it difficult to read the gradations at the lower-value pixel positions, losing freshness of images. To resolve this, the cycle of voltage applied to the divided groups of the electrodes 15 and the number of application times of voltage are adjusted. Practically, the number of application times for the electrodes residing in lower-luminance pixel positions is raised to reduce the application cycle, while the number of application times for the electrodes residing in higher-luminance pixel positions is reduced to increase the application cycle. It is therefore possible that the localized luminances emanated from the gas discharge tube 14 are adjusted within each field, area by area, based on what type of image is displayed.

Fifth Embodiment

Referring to FIGS. 10 to 12A and 12B, a fifth embodiment of the present invention will now be described.

Figure 10:
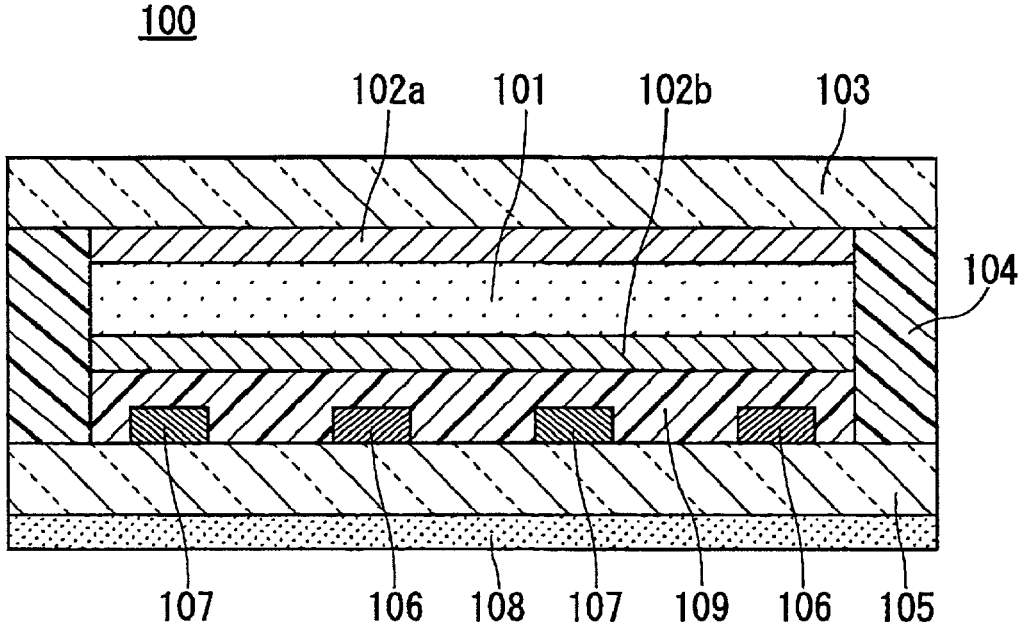
FIG. 10 shows in section part of a gas discharge tube used by a display apparatus according to a fifth embodiment of the present invention.

FIG. 10 shows a sectional view of a flat type of gas discharge tube 100 according to the fifth embodiment. As shown in FIG. 10, this flat type of gas discharge tube 100 has a front glass substrate 103, rear glass substrate 105, and wall members 104, so that a discharging space 101 is formed air-tightly. On an inner surface of the front glass substrate 103, a fluorescent layer 102*a* is formed. On an inner surface of the rear glass substrate 105, a dielectric layer 109 and a fluorescent layer 102*b* are laminated in this order. Additionally, a pair of sustaining electrodes 106 and 107 or more pairs of those electrodes 106 and 107 are arranged on the inner surface of the rear glass electrodes 105, with covered by the dielectric layer 109. An auxiliary electrode 108 is arranged on the outer surface of the back glass substrate 105. The discharging space 101 is filled with rare gas, such as Ne—Ar, Xe—Ar, or Hg.

Figure 11:
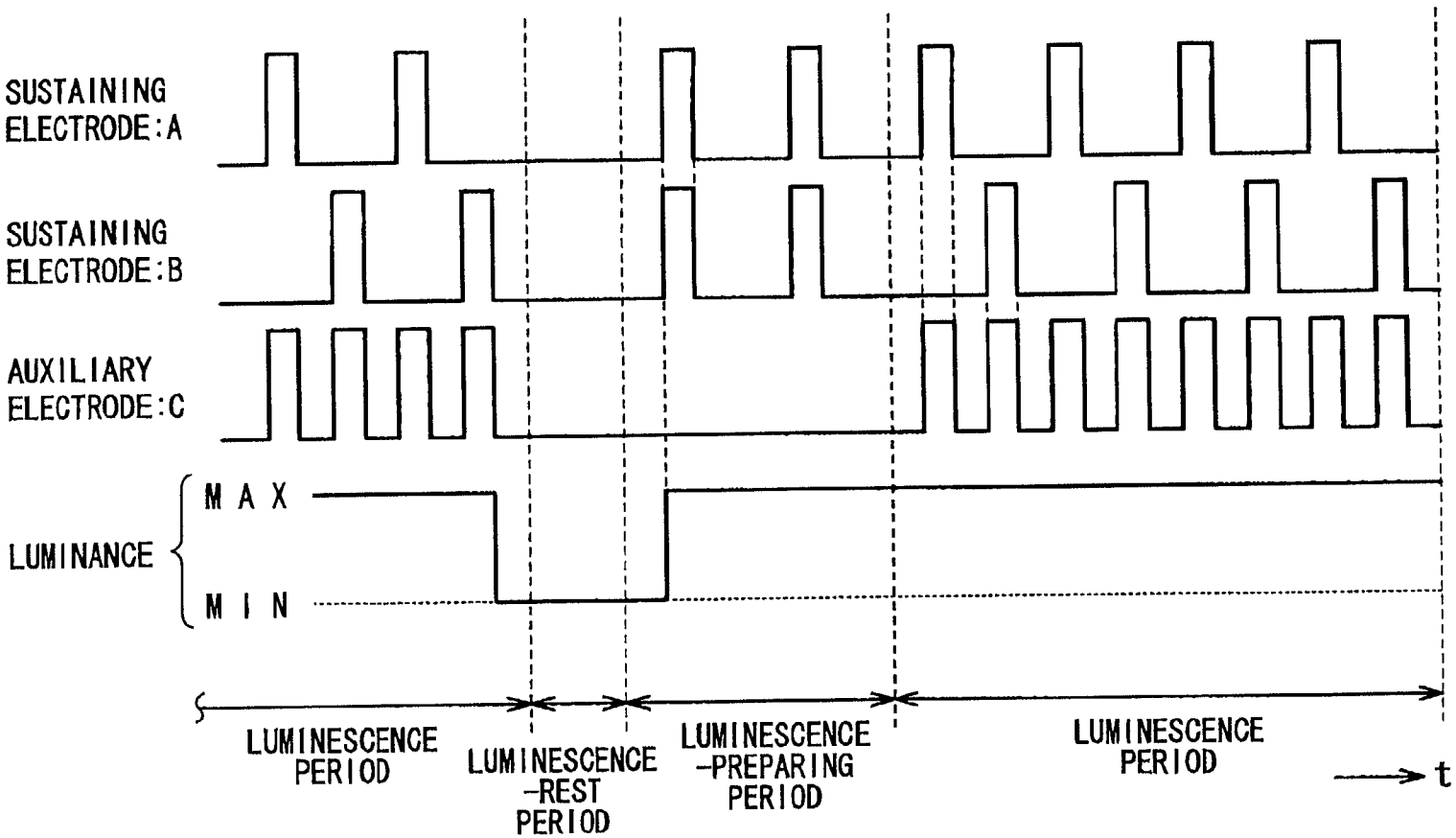
FIG. 11 represents timing charts to explain both voltage pulses applied to electrodes and luminance characteristics according to the fifth embodiment.

FIG. 11 shows voltages applied to the sustaining electrodes 106 and 107 and the auxiliary electrode 108, in addition to luminescence states of the gas discharge tube 100. An arbitrary unit time, corresponding to a period of time of one field, consists of a luminescence period serving as a luminescence step, a luminescence-rest period serving as a luminescence-rest step, and a luminescence-preparing period serving as a luminescence-preparing step.

During the luminescence period, two types of pulsed voltages, whose phases are shifted by an amount of half of one cycle, are applied to the sustaining substrates 106 and 107, respectively. No voltage is applied to both the sustaining substrates 106 and 107 during the luminescence-rest period. Further, during the luminescence-preparing period, two types of pulsed voltages, whose phases agree with each other, are applied to the sustaining substrates 106 and 107, respectively.

With respect to the auxiliary substrate 108, a pulsed voltage formed by mutually summing the pulsed voltages applied to both the sustaining electrodes 106 and 107 is applied during the luminescence period. In both of the luminescence-rest and luminescence-preparing periods, a constant-amplitude voltage is applied to the auxiliary substrate 108, which is the ground level in this embodiment.

The above pulsed voltages, which are formed into rectangular pulses of which amplitudes are equal to each other, are used for pulsated excitation of the rare gas so that discharge is generated using dielectric barrier configurations.

Figure 12A:
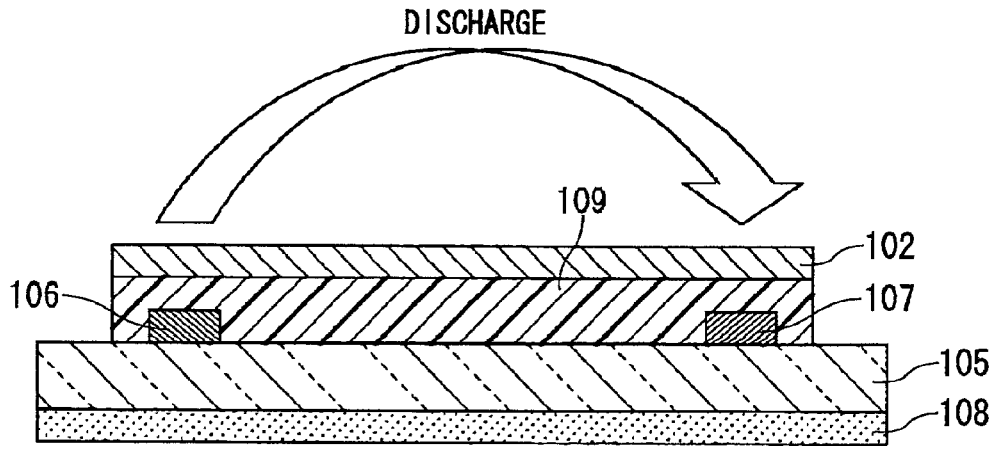
FIGS. 12A and 12B illustrate two types of discharge, one of which being generated between sustaining electrodes and the other being generated between a sustaining electrode and an auxiliary electrode.
Figure 12B:
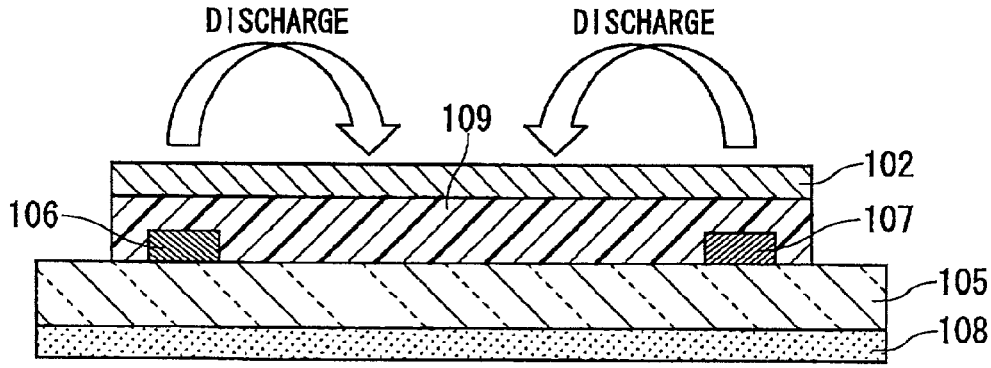

The excitation of the gas discharge tube 100 is illustrated in FIGS. 12A and 12B. A pulsated excitation during the luminescence period causes a primary discharge between both the sustaining electrodes 106 and 107, as shown in FIG. 12A, whereas a discharge between one sustaining electrode 106 and the auxiliary electrode 108 will be suppressed. To avoid localized discharges, it is required that the voltage pulses to both the sustaining electrodes 106 and 107 be optimized in their frequencies and pulse widths, because the discharges between both the sustaining electrodes 106 and 107 involve a larger amount of discharge current.

FIG. 12B illustrates discharges occurring during the luminescence-preparing period. Since the waveforms of the voltage pulses applied to both of the sustaining electrodes 106 and 107 agree with each other in terms of their phases and amplitudes, no difference in potential is yield therebetween. However, a certain potential difference is generated between the auxiliary electrode 108 and each of the sustaining electrodes 106 and 107, respectively. Hence the pulsated excitation between the auxiliary electrode 108 and the sustaining electrodes 106 and 107 leads to discharges occurring between the auxiliary electrode 108 and each sustaining electrode 106 (107). The discharge current involved in the discharges with the auxiliary electrode 108 is less in amount than half of that carried out between both the sustaining electrodes 106 and 107. Thus the frequency and pulse width of the voltage pulses applied to the sustaining electrodes 106 and 107 during the luminescence-preparing period can be determined in a flexible manner. That is, the conditions for setting the waveform of a pulsed voltage applied during the luminescence-preparing period are more moderate than the conditions required during the luminescence period.

Thus, the discharge can be generated at first between the auxiliary electrode 108 and each of the sustaining electrodes 106 and 107, so that space electric charges can be produced before entering the luminescence period. Using the preparatory discharges, the sustaining discharges can easily be generated between the sustaining electrodes between the sustaining electrodes 106 and 107. Hence, the flat type of gas discharge tube 100 can be provided with the sustaining discharge provided with stability.

Figure 13:
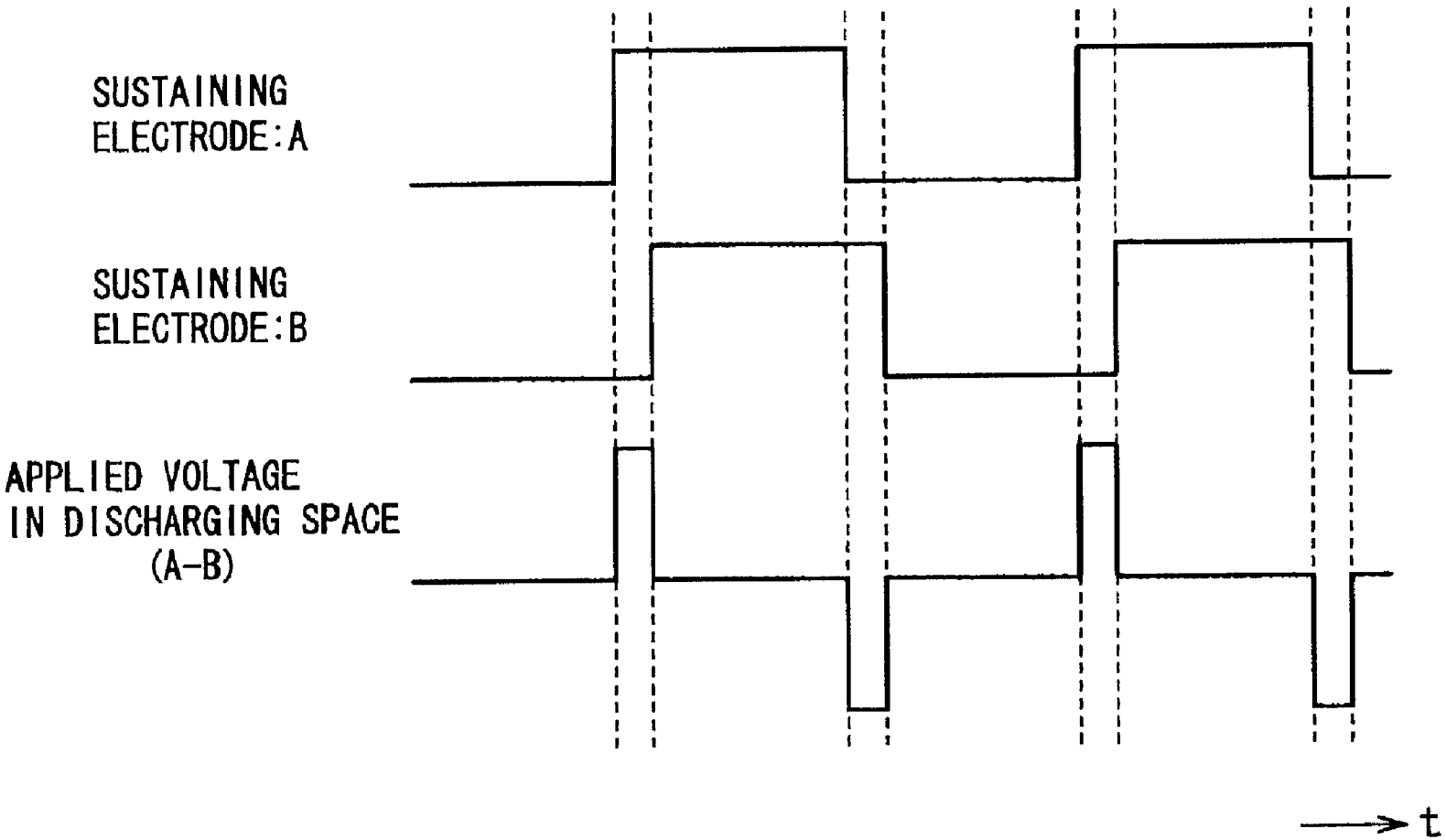
FIG. 13 shows voltage pulses applied to sustaining electrodes in a modification of the fifth embodiment.

FIG. 13 shows a modified example of the waveforms of voltage pulses applied to the gas discharge tube 100. The duty ratio of each of the waveforms is set to 50%, and there is a phase difference between the voltage waveforms applied to both the sustaining electrodes 106 and 107. This creates a potential difference in the discharging space 101, thus causing discharges therein. Using these waveforms of the voltages makes it possible to reduce a drive frequency of each pulsed voltage and lessen the power consumed by drive circuits for the electrodes. The duty ratio shows a percentage of the duration of a pulsed voltage to be applied, compared to a period of one cycle.

Applying to the substrates the voltage pulses of the waveforms shown in FIG. 13 brings about a moderate imbalance among the distributed space electric charges. Therefore, compared to the application of the voltage pulses each having a duty ratio of less than 10%, the luminance of the flat type of gas discharge tube is raised more. The duty ratio may be set to an amount selected from the range of approximately 10 to 90%, still providing the similar effect.

The voltage pulses of the pulse widths shown in FIG. 13 can be applied to the electrodes during the luminescence-rest period and/or the luminescence period, still providing the foregoing advantage as well.

Figure 14:
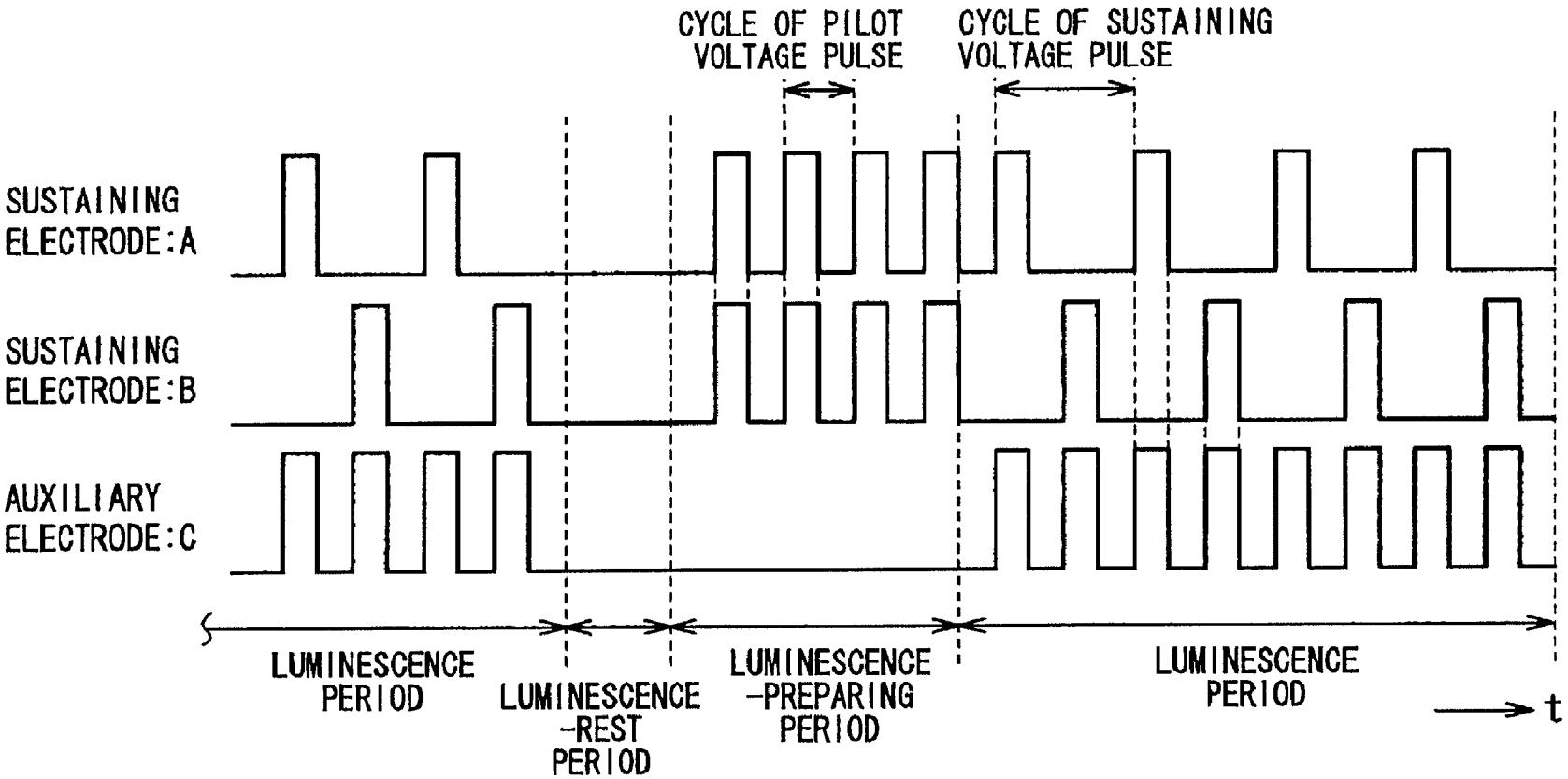
FIG. 14 also shows voltage pulses applied to sustaining electrodes in a second modification of the fifth embodiment.

FIG. 14 illustrates an alternative modification showing the waveforms of voltage signals that can also be applied to the gas discharge tube 100. In this modification, pilot voltage pulses, which are applied to the sustaining electrodes 106 and 107 during the luminescence-preparing period, are different in cycles from those pulses applied during the luminescence period. By setting such different cycles of the pulses between the luminescence-preparing and the luminescence periods, the start point of a display period coming after the occurrence of a pilot discharge caused by the application of the pilot voltage pulses can be determined arbitrarily. Hence, the sustaining discharges can be restarted according to the intensity of the pilot discharge and discharge characteristics of the gas discharge tube 100, so that the sustaining discharges become stable.

As stated above, the present embodiment adopts the auxiliary electrode 108 firmly placed on the rear glass substrate 105, as part of on the gas discharge tube 100. An alternative is that the auxiliary electrode 108 may be separated by a distance of 10 cm or less from the body of the tube, that is, from the rear glass substrate 105. Such a configuration is also available to the present invention.

As described above, the fifth embodiment and its various modifications provide the flat type of gas discharge tube and how to control the luminescence, in which one or more pairs of sustaining electrodes 106 and 107 are arranged in parallel to each other. Specifically, each field of an arbitrary unit time is divided into, as described before, the luminescence-rest, luminescence-preparing, and luminescence periods. A third electrode, that is, the auxiliary electrode 108, is arranged to help the restart of the sustaining discharge. In addition, during the luminescence-preparing duration, no discharges occur between both the sustaining electrodes 106 and 107, while discharges occur between the auxiliary electrode 108 and each of the sustaining electrodes 106 and 107 with the amount of discharge current regulated. On completing this preparation period, the luminescence period starts, where the discharges are generated between the sustaining electrodes 106 and 107.

In other words, in cases where the space electric charges in the discharging space 101 are reduced because the luminescence has been rested during the luminescence-rest period, moderate discharges, which are at least not localized at a single position, are carried out between the auxiliary electrode 108 and each of the sustaining electrodes 106 and 107. Those preparatory discharges cause a proper map of the space electric charges within the discharging space 101. The preparatory discharges are followed by the primary discharges carried out between the sustaining electrodes 106 and 107. This enables the sustaining discharges to start with stability, while still having the luminescence-rest period that is continuous.

Sixth Embodiment

Figure 16:
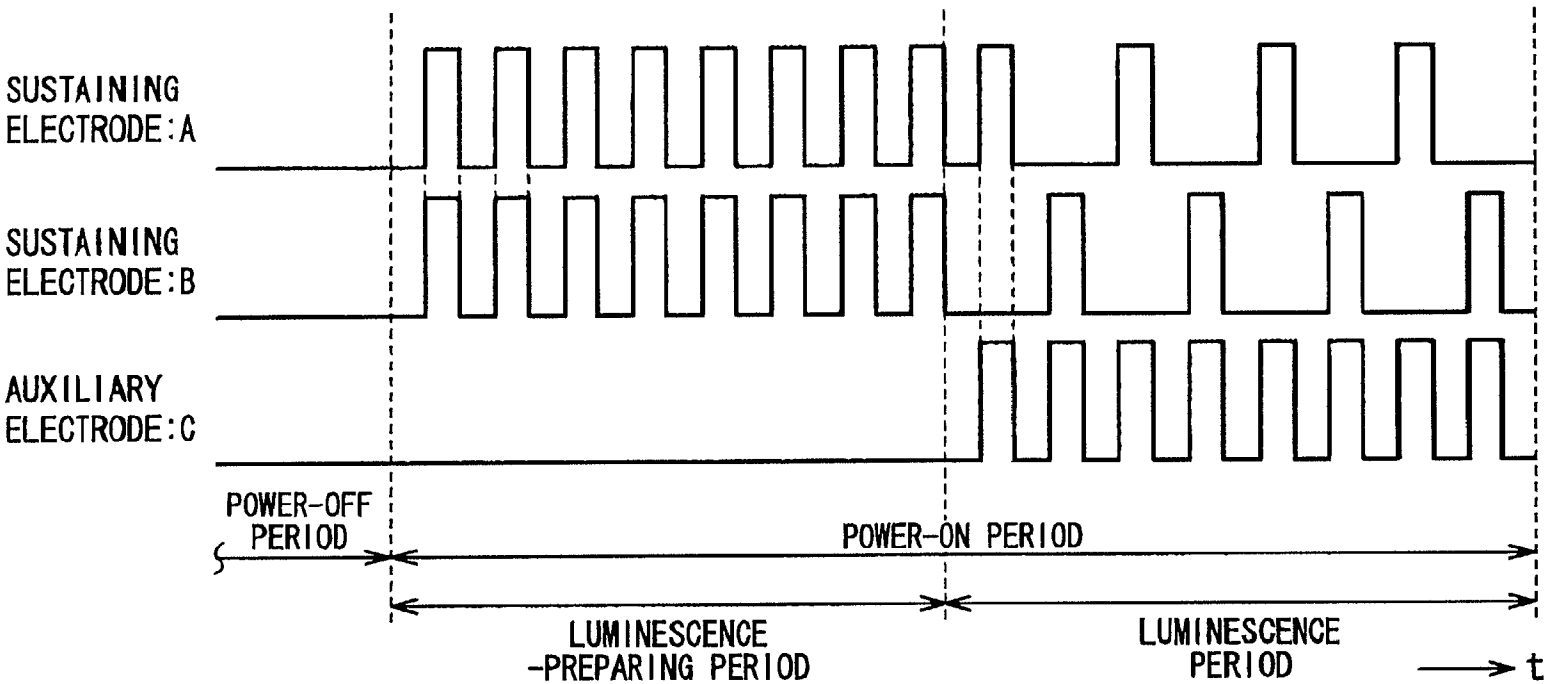
FIG. 16 represents timing charts to explain voltage pulses applied to electrodes according to a sixth embodiment of the present invention.

Referring to FIGS. 10 and 16, a sixth embodiment of the present invention will now be detailed.

FIG. 16 shows the waveforms of voltage pulses applied to the sustaining electrodes 106 and 107 and the auxiliary electrode 108 of the flat type of gas discharge tube 100 shown in FIG. 10.

As shown in FIG. 16, the luminescence-rest period is switched to the luminescence-preparing period by turning the power source on. The luminescence-preparing period serves as a luminescence-preparing step activated before the luminescence step. During the luminescence-preparing period, applied are pilot voltage pulses of which waveforms are the same, but different in cycles from sustaining voltage pulses to be applied during the luminescence period. This application brings about discharges between each of the sustaining electrodes 106 and 107 and the auxiliary electrode 108 in accordance with the pilot voltage pulses.

Accordingly, the conventional problem can be solved that no discharges are brought about because of the shortage of amount of applied voltages in cases where the luminescence-rest period (power off) is directly switched over to the luminescence period (power on). The direct switchover from the luminescence-rest period to the luminescence period causes fewer amounts of space electric charges in the discharging space 101. Frequently, such amounts of the space electric charges are not enough to cause discharge between the sustaining electrodes 106 and 107, thus giving rise to a delayed start of the discharge or unstable discharge actions.

In contrast, as shown in FIG. 16, placing the luminescence-preparing period between the luminescence-rest and luminescence periods makes it possible to steadily produce space electric charges in the discharging space 101 before the luminescence period. Therefore, when entering into the luminescence period, a satisfactory amount of space electric charges accumulated in the discharging space 101 can be used to activate the discharges, whereby not only avoiding a delayed start of the discharge actions but also providing unstable discharge actions.

The pulsed voltages shown in FIG. 14 can also be used in the foregoing sequence of the pulsed voltages shown in FIG. 16.

As described so far, in the case that the space electric charges are insufficient when this flat type of gas discharge tube 100 is put into operation after a long time of rest, the discharge actions will be first started between each of the sustaining electrodes 106 and 107 and the auxiliary electrode 108. Since the distances between each of the sustaining electrodes 106 and 107 and the auxiliary electrode 108 are shorter that that between sustaining electrodes 106 and 107, each voltage pulse to start the discharge can be lowered in amplitude.

When the gas discharge tube 100 has been unused for a long time and put in the dark place, there are left only a small number of space electric charges in the discharging space 101, which is extremely reduced in number. Furthermore, the distances between the sustaining electrodes 106 and 107 are relatively longer. Because there are such disadvantages, the sustaining electrodes 106 and 107 are likely to be subjected to the voltage shortage and some other unfavorable conditions. Thus, not only a delayed start of the discharge actions due to the start in the dark place, called the dark start, but also unstable discharge actions are caused. These problems can be solved by the present invention, because there is interleaved the luminescence-preparing period between the luminescence-rest and luminescence periods. In the interleaved period, the discharge is first started between each of the sustaining electrodes 106 and 107 and the auxiliary electrode 108, the distance between such paired electrodes being shorter than that between the sustaining electrodes 106 and 107. Hence a voltage pulse of lower amplitude is still sufficient to start the discharge, providing a stable initial start without using a particular black-start voltage signal or a luminary element for starting the discharge.

Seventh Embodiment

Figure 17:
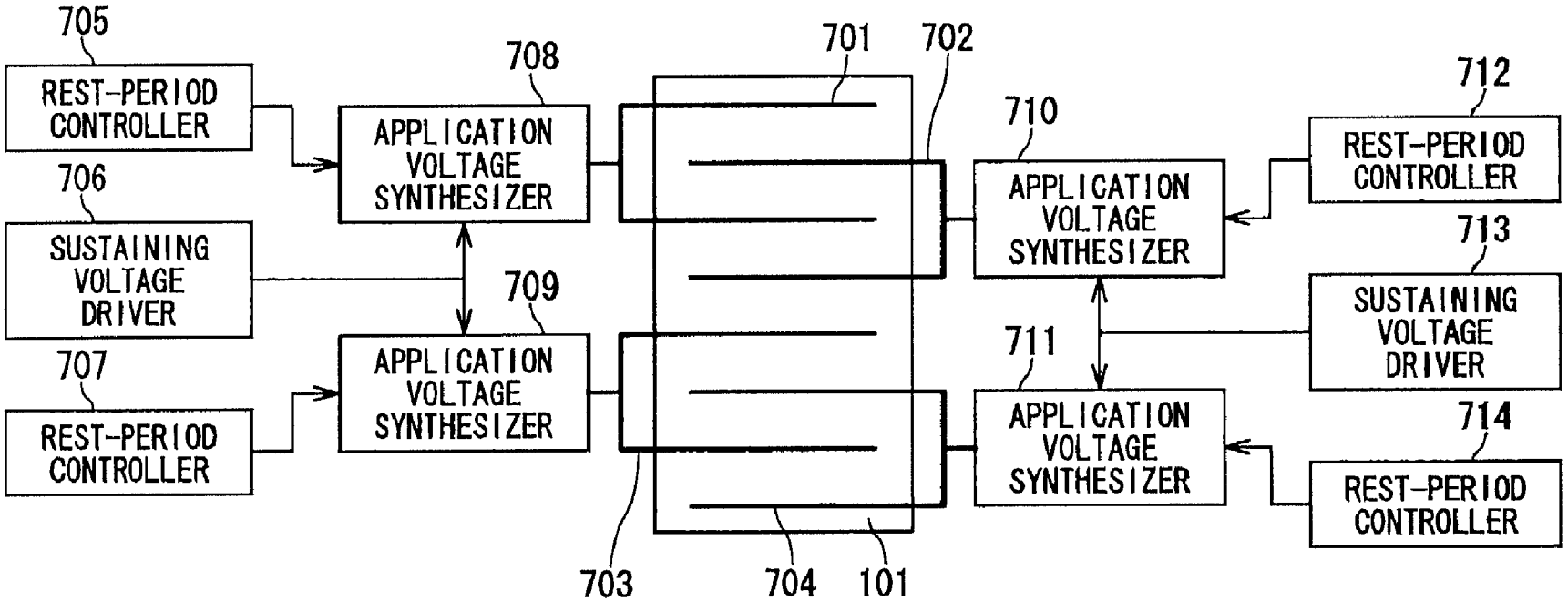
FIG. 17 is a schematic diagram showing the control means and part of a gas discharge tube used by a display apparatus according to a sixth embodiment of the present invention.
Figure 18:
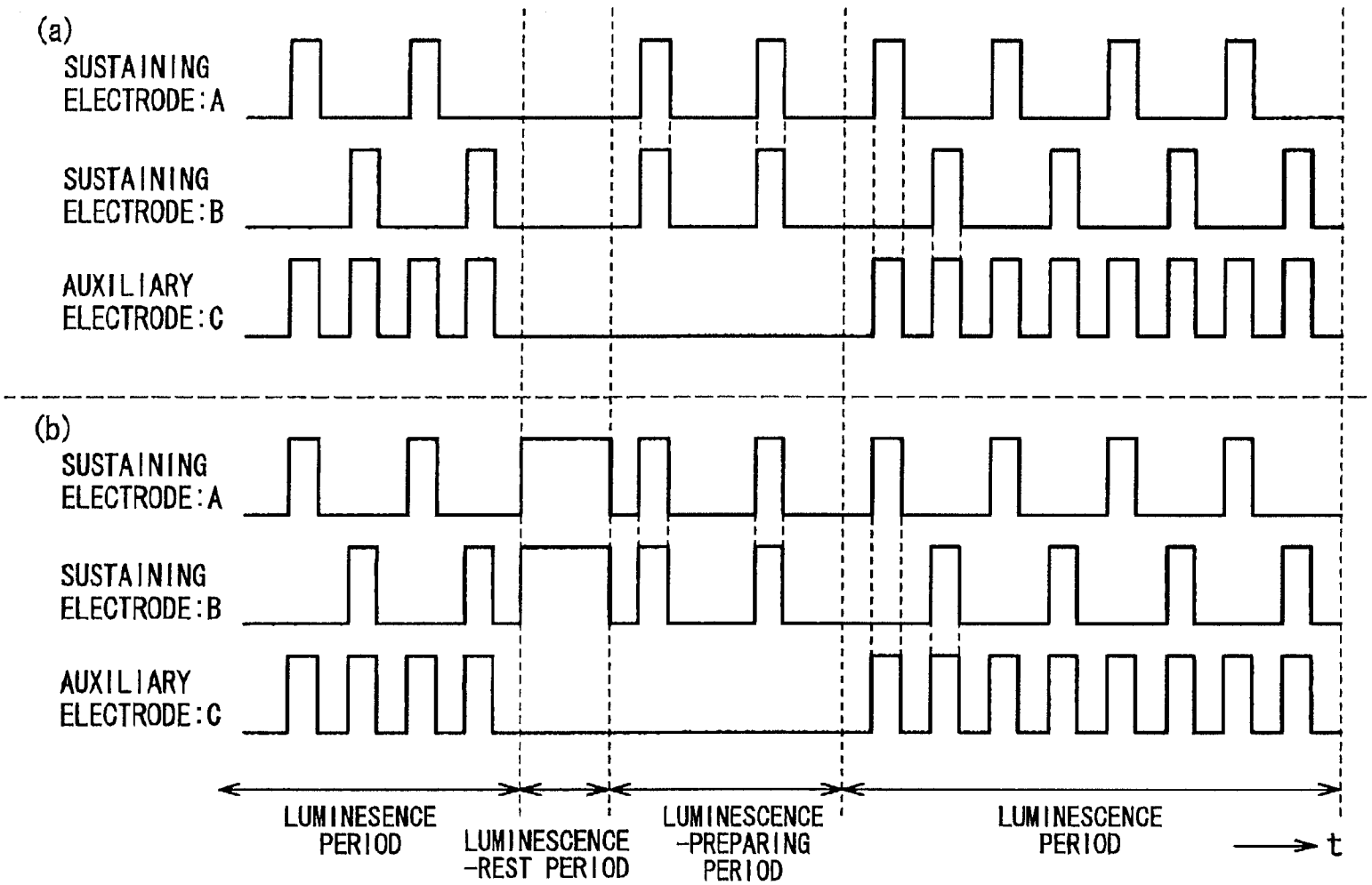
FIG. 18 shows timing charts to explain voltage pulses applied to electrodes according to a seventh embodiment of the present invention.

Referring to FIGS. 10, 17 and 18, a seventh embodiment of the present invention will now be detailed.

FIG. 17 outlines the configurations of both of the flat type of gas discharge tube 100 and its drive elements 705 to 714. The discharge region of the gas discharge tube 100 is divided into a plurality of regions by sustaining electrodes 701 to 704. Practically, by way of example, each of the sustaining electrodes 701 to 704 is composed of two linear electrodes arranged in the discharging space 101 and connected to each other outside the discharging space 101. And all the sustaining electrodes 701 to 704 are spatially combined and disposed in a mutually faced toothcomb-like form, as pictorially shown in FIG. 17. The discharge region is divided into two upper and lower regions in the figure.

The drive elements 705 to 714, which are incorporated in the discharge controller 16 shown in FIG. 4, are composed of sustaining voltage drivers 706 and 713, rest-period controllers 705, 707, 712 and 714, and application voltage synthesizers 708 to 711.

Of these constituents, the sustaining voltage drivers 706 and 713 are in charge of producing both of a sustaining voltage pulse and a pilot voltage pulse. One sustaining voltage driver 706 is connected to the circuitry directed to both of the sustaining electrodes 701 and 703, whereas the other sustaining voltage driver 713 is connected to the circuitry directed to both of the sustaining electrodes 702 and 704.

The rest-period controllers 705, 707, 712 and 714 are configured to control the potential required during the luminescence-rest period, respectively. The controller 705 is connected to the application voltage synthesizers 708 connected to the sustaining electrode 701. The controller 707 is connected to the application voltage synthesizers 709 connected to the sustaining electrode 703. Furthermore, the controller 712 is connected to the application voltage synthesizers 710 connected to the sustaining electrode 702. The controller 714 is connected to the application voltage synthesizers 711 connected to the sustaining electrode 704.

Each of the application voltage synthesizers 708 to 711 are configured to synthesize the sustaining voltage pulse, the pilot voltage pulse, and a rest-period voltage into a sequence of pulses aligning in the time axis.

FIGS. 18A and 18B show the voltage pulses to be applied to the gas discharge tube 100. Particularly, FIG. 18A exemplifies the voltage pulses being applied to both the sustaining electrodes 701 and 703, where the voltage applied to each of such electrodes 701 and 703 during the luminescence-rest period are grounded, thus voltage for starting the discharge being lowered. FIG. 18B exemplifies the voltage pulses being applied to both the sustaining electrodes 702 and 704, where the voltage applied to each of such electrodes 702 and 704 during the luminescence-rest period are a high value, thus voltage for starting the discharge being raised.

Controlling the amplitude of the voltage applied during the luminescence-rest period allows the luminescence of the gas discharge tube 100 to be controlled. Hence, with no drivers arranged region by region, the light control is possible in a regionally divided manner. When the gas discharge tube 100 is used as a backlight of such a unit as an LCD, image data to be displayed can be subjected to light control according to their regional luminance characteristics, providing higher-quality images on an LCD unit.

The pulsed voltages shown in FIG. 14 can also be used in the foregoing sequence of the pulsed voltages shown in FIG. 18.

As described above, the entire discharge region of the flat type of gas discharge tube 100 shown in FIG. 10 is divided into a plurality of sub-regions, which can be light-emitted independently of each other. This localized luminescence, which is possible due to changes in the start voltage of the discharge when entering the luminescence period, is realized by controlling the voltage applied to the sustaining electrodes 701 to 704 during the luminescence-rest period. Accordingly, the discharge is controllable at every sub-region.

In the above seventh embodiment, the auxiliary electrodes 108 has received the voltage of the ground level or the same level as that of the sustaining voltage, but this can be modified. For example, the auxiliary electrodes 108 may receive two types of potentials as long as there is a potential difference of 50 Volts or more between the potentials.

Further, a modification with respect to the division of the display region can be provided. The division is not limited to the way to divide the region into tow sub-regions, but the discharge region can be divided into an arbitrary number of sub-regions.

The gas discharge tube 100 according to the foregoing fifth to seventh embodiments may be put into practice with a variety of modified forms, which will be described below.

Figure 15:
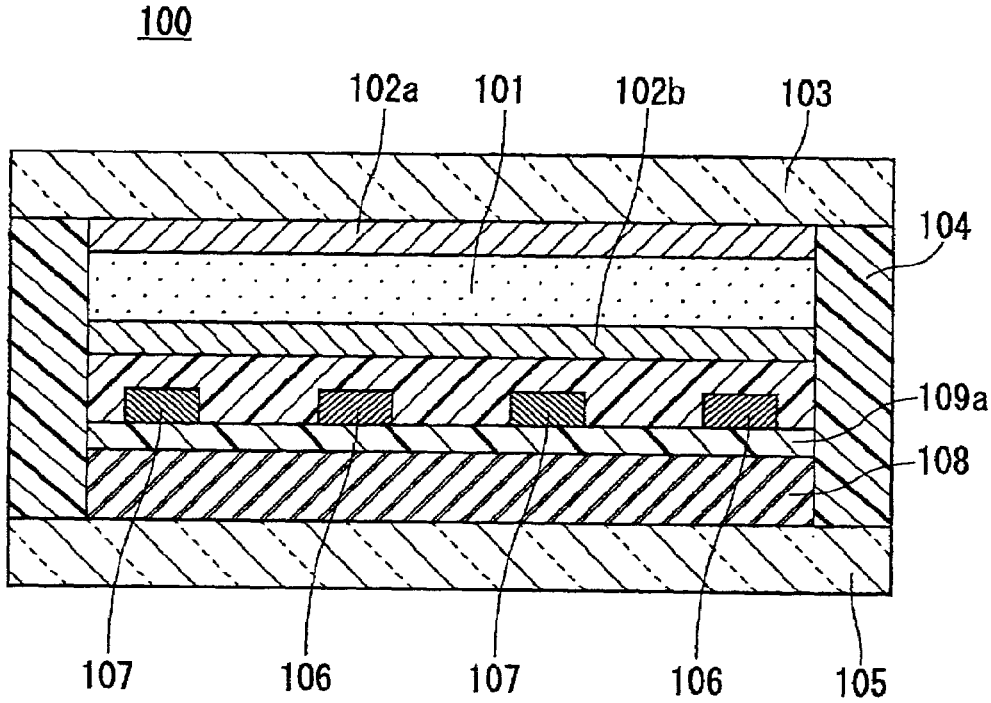
FIG. 15 shows in section part of a gas discharge tube used by a display apparatus according to a modification which can be adapted to various embodiments of the present invention.

There is provided an alternative modification concerning the layered structure of the flat type of gas discharge tube 100. As shown in FIG. 15, in place of being the auxiliary electrode 108 disposed on the outer surface of the rear glass substrate 105, the auxiliary substrate 108 may be disposed on the inner surface of the rear glass substrate 105. Further, in that structure, a first dielectric member 109*a*, the sustaining electrodes 106 and 107, a second dielectric member 109*b*, and the fluorescent layer 102*b* are laminated in this order on the auxiliary layer 108, thus forming one side of the discharging space 101. This laminated structure is also able to provide the foregoing operations and advantages.

Alternatively, the auxiliary electrode 108 may be formed by a transparent electrode, in which the transparent auxiliary electrode 108 is arranged on the outer surface of the front glass substrate 103. This structure can also provide the foregoing operations and advantages.

Still, the sustaining electrodes 106 and 107 may be formed by transparent electrodes, in which the transparent sustaining electrodes 106 and 107, the dielectric member 109, and the fluorescent member 102 are laminated in this order on the inner surface of the front glass substrate 103. This creates the same or similar advantage as or to the above.

In the foregoing embodiments, the sustaining electrodes 106 and 107 have been disposed on the rear glass substrate 105, but it is possible that such electrodes 106 and 107 are formed on the wall members 104.

Still, the arrangement of the auxiliary electrode 108 is not limited to the example shown in FIG. 10 in which it is disposed on the rear glass substrate 105. The auxiliary electrode 108 may be arranged on the outer or inner surface on the wall members 104.

The present invention may be embodied in other specific forms without departing from the spirit or essential characteristics thereof. The present embodiments are therefore to be considered in all respects as illustrative and not restrictive, the scope of the present invention being indicated by the appended claims rather than by the foregoing description and all changes which come within the meaning and range of equivalency of the claims are therefore intended to be embraced therein.

What is claimed is:

1. A display apparatus comprising:

a shutter of which light transmittance is changeable;

a gas discharge tube for lightening the shutter;

a shutter controller for controlling the light transmittance of the shutter on the basis of luminance information about an image to be displayed; and a discharge controller for controlling a discharge state of the gas discharge tube in accordance with a light transmittance state acquired when the shutter controls the light transmittance responsively to the luminance information; wherein the discharge controller includes:

a field detector configured to detect a period of each field from the image to be displayed;

a lighting period controller configured to control the period of each field so that the period of each field is divided in sequence into a luminescence-rest period during which the gas discharge tube is subjected to either one of a reduction of an intensity of light emitting therefrom and a rest of the luminescence thereof in cases where the light transmittance state of the shutter is out of a desired light transmittance range, a luminescence-preparing period during which the luminescence of the gas discharge tube is prepared, and a luminescence period during which the gas discharge tube performs the luminescence; and an applied-voltage generator configured to generate a voltage signal to be supplied to the gas discharge tube, the voltage signal being formed depending on a difference among the luminescence-rest, luminescence-preparing, and luminescence periods.

2. The display apparatus of claim 1, wherein the shutter controller includes a shutter control signal generator configured to generate a shutter control signal for controlling the light transmittance of the shutter from the luminance information about the image, and the discharge controller further includes a luminance detector configured to detect a luminance of the image from the shutter control signal, wherein the lighting period controller is configured to changeably control a length of the luminescence-rest period in accordance with the luminance of the image detected by the luminance detector.

3. The display apparatus of claim 1, wherein the discharge controller is configured to allow the gas discharge tube to not only reduce an intensity of light emitted therefrom in cases where the light transmittance state of the shutter is out of a desired light transmittance range but also to perform luminescence toward the shutter in cases where the light transmittance state of the shutter begins falling into the desired light transmittance range.

4. The display apparatus of claim 1, wherein the discharge controller is configured to allow the gas discharge tube to not only rest luminescence thereof during a first specified period in cases where the light transmittance state of the shutter is out of a desired light transmittance range but also to perform the luminescence toward the shutter during a second specified period in cases where the light transmittance state of the shutter begins falling into the desired light transmittance range.

5. The display apparatus of claim 4, wherein the discharge controller is configured to apply to the gas discharge tube a voltage for preparing the luminescence during a certain period of time residing in an early part of the second specified period.

6. The display apparatus of claim 5, wherein the discharge controller is configured to make a duration of the voltage for preparing the luminescence longer than a duration of voltage to be applied to the gas discharge tube during a remaining period of time in the second specified period.

7. The display apparatus of claim 1, wherein the discharge controller is configured to make the gas discharge tube lighten the shutter continuously for a desired number of field periods independently of the light transmittance state of the shutter when the display apparatus is first put into operation.

8. A method of driving a gas discharge tube having a plurality of glass substrates placed to form a discharging spacing with which a rare gas is filled, one or more pairs of sustaining electrodes embedded in a dielectric layer, and an auxiliary electrode placed insulatedly apart from the sustaining electrodes, the method comprising the steps of:

performing a luminescence rest by applying two voltages whose amplitudes are the same and constant to two sustaining electrodes composing each pair among the paired sustaining electrodes, so that the two sustaining electrodes composing each pair rest the discharge;

performing a luminescence preparation during a predetermined time of period, after performing the luminescence rest, by not only applying two voltage pulses whose phases are the same to the two sustaining electrodes composing each pair but also applying a voltage to cause a preparatory discharge to the auxiliary electrode; and performing a luminescence of the gas discharge tube, after performing the luminescence preparation, by applying two voltage pulses whose phases are mutually shifted to the two sustaining electrodes composing each pair, so that the sustaining electrodes cause discharge for the luminescence.

9. The driving method of claim 8, wherein the two voltage pulses applied to the two sustaining electrodes composing each pair are mutually shifted in phases by half a cycle of each voltage pulse.

10. The driving method of claim 8, wherein during the luminescence step, a summed voltage of the two voltage pulses is applied to the auxiliary electrode.

11. The driving method of claim 8, wherein during the luminescence step, each of the two voltage pulses applied to the two sustaining electrodes composing each pair is set to have a duty ratio ranging from approximately 10 to 90 percents.

12. The driving method of claim 11, wherein during the luminescence step, the two voltage pulses applied to the two sustaining electrodes composing each pair are adjusted in the phases so that a pulsed waveform of voltage generated in the discharging spacing is adjusted in pulse width.

13. The driving method of claim 8, wherein the two voltage pulses applied to the two sustaining electrodes composing each pair during the luminescence-preparing step are different in a cycle from the two voltage pulses applied to the two sustaining electrodes composing each pair during the luminescence step.

14. The driving method of claim 8, wherein voltage pulses from a first voltage pulse to a desired number of voltage pulses in a pulse sequence of each of the two voltage pulses applied to the two sustaining electrodes composing each pair during the luminescence-preparing step are different in a duty ratio from the two voltage pulses applied to the two sustaining electrodes composing each pair during the luminescence step.

15. The driving method of claim 8, wherein the luminescence-rest step is omitted during a predetermined period of time in an initial start state immediately after power of the display apparatus is put on.

16. The driving method of claim 8, further comprising a step of performing a preparation for initial-start luminescence by not only applying two voltage pulses whose phases are the same to the two sustaining electrodes composing each pair but also applying a voltage to cause a preparatory discharge to the auxiliary electrode, in an initial start state immediately after power of the display apparatus is put on, the initial-start luminescence-preparing step being followed by the luminescence step.

17. The driving method of claim 8, wherein the sustaining electrodes are arranged so as to divide a discharging area of the gas discharge tube into a plurality of sub-areas, and during the luminescence-rest step, sustaining electrodes located in a sub-area subjected to the luminescence are grounded and sustaining electrodes located in a sub-area subjected to non-luminescence are given voltage of a predetermined amplitude.

18. A gas discharge tube configured to be driven by the driving method according to claim 8.

* * * * *

UNITED STATES PATENT AND TRADEMARK OFFICE

CERTIFICATE OF CORRECTION

PATENT NO. : 7,053,871 B2
APPLICATION NO. : 10/157183
DATED : May 30, 2006
INVENTOR(S) : Tomida Kazou et al.

It is certified that error appears in the above-identified patent and that said Letters Patent is hereby corrected as shown below:

Title Page of the patent, Item "56 References Cited", below the listing of the Japanese reference "JP 2001-125066 5/2001", insert the following:

-- OTHER PUBLICATIONS

M. ILMER, et al., "Hg-free Flat Panel Light Source PLANON – A Promising Candidate for Future LCD Backlights", *Society for Information Display International Symposium Digest of Technical Papers*, Vol. 31, May 16-18 2000, pp. 931-933

Y. IKEDA et al., "Ranging from 0.5 to 5.2 in. Diagonals", *Society for Information Display International Symposium Digest of Technical Papers*, Vol. 31, May 16 – 18, 1000, pp. 938-941 --

Signed and Sealed this

First Day of May, 2007

JON W. DUDAS
*Director of the United States Patent and Trademark Office*